US010234086B2

(12) United States Patent
Nathaniel

(10) Patent No.: US 10,234,086 B2
(45) Date of Patent: Mar. 19, 2019

(54) DECORATIVE LIGHTING SYSTEM

(71) Applicant: Alec Nathaniel, Vineland, NJ (US)

(72) Inventor: Alec Nathaniel, Vineland, NJ (US)

( * ) Notice: Subject to any disclaimer, the term of this patent is extended or adjusted under 35 U.S.C. 154(b) by 0 days.

(21) Appl. No.: 15/632,267

(22) Filed: Jun. 23, 2017

(65) Prior Publication Data

US 2018/0010743 A1 Jan. 11, 2018

Related U.S. Application Data

(60) Provisional application No. 62/353,691, filed on Jun. 23, 2016.

(51) Int. Cl.

| | |
|---|---|
| ***F21S 4/10*** | (2016.01) |
| ***F21K 9/237*** | (2016.01) |
| ***F21V 23/06*** | (2006.01) |
| ***F21V 3/02*** | (2006.01) |
| ***F21V 15/02*** | (2006.01) |
| ***F21V 15/01*** | (2006.01) |

(52) U.S. Cl.

CPC ..... *F21S 4/10* (2016.01); *F21K 9/237* (2016.08); *F21V 3/02* (2013.01); *F21V 15/01* (2013.01); *F21V 23/06* (2013.01); *F21V 15/012* (2013.01)

(58) Field of Classification Search

CPC ..... F21S 4/10; F21S 4/26; F21S 4/006; F21S 4/00; F21K 9/237; F21K 9/238; F21V 15/01; F21V 15/012

See application file for complete search history.

(56) References Cited

U.S. PATENT DOCUMENTS

| | | | | | |
|---|---|---|---|---|---|
| 4,885,664 | A * | 12/1989 | Hermanson | F21S 4/20 | 264/281 |
| 5,057,981 | A * | 10/1991 | Bowen | F21S 4/20 | 362/219 |
| 5,441,224 | A * | 8/1995 | Ludwig | F16L 3/22 | 248/74.2 |
| 5,624,180 | A * | 4/1997 | Lanning | B44C 5/00 | 248/68.1 |
| 5,791,762 | A * | 8/1998 | Wroblewski | F21V 19/0005 | 362/152 |
| 5,951,148 | A * | 9/1999 | Limber | F21V 9/08 | 362/227 |
| 6,019,494 | A * | 2/2000 | Lee | F21V 19/0005 | 362/121 |
| 6,033,088 | A * | 3/2000 | Contigiani | F21V 17/007 | 362/249.14 |
| 6,224,232 | B1 * | 5/2001 | Rodriguez | F21V 15/01 | 362/145 |
| 6,265,834 | B1 * | 7/2001 | Lin | F21V 23/06 | 315/185 S |
| 6,352,355 | B1 * | 3/2002 | Law | D04D 9/04 | 362/234 |
| 6,367,953 | B1 * | 4/2002 | Lee | F21V 21/06 | 362/240 |

(Continued)

*Primary Examiner* — Daniel I Walsh
(74) *Attorney, Agent, or Firm* — Paul & Paul

(57) ABSTRACT

A sleeve for decorative lighting helps prevent tangled lighting wires. The sleeve has clamps at each end that clamp the lighting wires. The sleeve is flexible and may be elastic. The sleeve may be a light diffuser so that the decorative lighting can be used while in the sleeve. A decorative lighting string has retractable lights and may be at least stored in the sleeve.

7 Claims, 23 Drawing Sheets

(56) References Cited

U.S. PATENT DOCUMENTS 6,394,623 B1 * 5/2002 Tsui ..... F21S 4/26 362/235
6,394,830 B1 * 5/2002 Huang ..... F21V 23/06 362/249.01
6,497,496 B2 * 12/2002 Wang ..... F21S 4/20 362/227
6,511,206 B1 * 1/2003 Fan Wong ..... F21S 4/20 362/249.16
6,688,754 B1 * 2/2004 Wu ..... F21V 9/16 362/249.01
6,908,213 B1 * 6/2005 Goodman ..... F21V 17/007 362/232
7,429,186 B2 * 9/2008 Mrakovich ..... F21V 21/002 439/404
8,322,886 B1 * 12/2012 Bowser ..... F21V 19/0075 362/261
9,306,352 B1 * 4/2016 Lin ..... H01R 4/5066
9,685,720 B1 * 6/2017 Wang ..... H01R 12/616
9,732,918 B2 * 8/2017 Wang ..... F21L 14/026
9,784,439 B2 * 10/2017 Baker ..... F21V 21/02
2002/0034074 A1 * 3/2002 Chen ..... F21S 4/20 362/249.01
2002/0075682 A1 * 6/2002 Lin ..... F21S 6/00 362/127
2002/0085380 A1 * 7/2002 Padermos ..... F21V 15/01 362/145
2002/0097577 A1 * 7/2002 Huang ..... F21S 10/06 362/240
2002/0168892 A1 * 11/2002 Frederick ..... F21S 9/04 439/501
2003/0004750 A1 * 1/2003 Teraoka ..... G06Q 10/02 705/400
2003/0086263 A1 * 5/2003 Huang ..... F21V 19/0005 362/249.01
2004/0012979 A1 * 1/2004 Squicciarini ..... B60Q 1/32 362/555
2004/0037080 A1 * 2/2004 Luk ..... H05B 33/0857 362/249.12
2004/0042220 A1 * 3/2004 Liou ..... F21V 21/0824 362/391
2004/0105278 A1 * 6/2004 Currie ..... G02B 6/001 362/551
2004/0233668 A1 * 11/2004 Telfer ..... F21S 4/10 362/249.16
2005/0024877 A1 * 2/2005 Frederick ..... F21S 9/04 362/277
2005/0036310 A1 * 2/2005 Fan ..... G09F 13/22 362/240
2005/0111221 A1 * 5/2005 Van Dyn Hoven ..... F21S 6/001 362/237
2005/0117339 A1 * 6/2005 Pan ..... A47F 11/10 362/249.01
2005/0195608 A1 * 9/2005 Wu ..... F21S 4/22 362/320
2005/0195609 A1 * 9/2005 Wu ..... F21S 4/22 362/320
2005/0225981 A1 * 10/2005 Kirven ..... F21V 17/007 362/249.14
2005/0230478 A1 * 10/2005 Chapman ..... G06K 1/12 235/462.13
2005/0286260 A1 * 12/2005 Liu ..... F21S 4/26 362/551
2006/0158878 A1 * 7/2006 Howell ..... F21S 4/10 362/223
2006/0158883 A1 * 7/2006 Wu ..... F21V 23/00 362/249.16
2007/0007030 A1 * 1/2007 Murphy ..... H01R 13/5213 174/92
2007/0121326 A1 * 5/2007 Nall ..... F21V 29/004 362/294
2007/0159822 A1 * 7/2007 Lin ..... F21V 19/0005 362/249.16
2007/0183147 A1 * 8/2007 Herlands ..... F21V 17/007 362/217.01
2007/0263385 A1 * 11/2007 Fan ..... G09F 13/22 362/249.16
2007/0279920 A1 * 12/2007 Lin ..... F21V 23/0407 362/362
2008/0285278 A1 * 11/2008 Bole ..... F21V 19/0005 362/249.01
2008/0310183 A1 * 12/2008 Fan ..... F21K 9/00 362/555
2009/0221401 A1 * 9/2009 Lovett ..... A63B 5/20 482/3
2009/0226643 A1 * 9/2009 Shih ..... D04D 7/10 428/4
2009/0273928 A1 * 11/2009 Rizopoulos ..... F21S 4/10 362/249.16
2010/0031997 A1 * 2/2010 Basol ..... H01L 31/048 136/244
2010/0127139 A1 * 5/2010 Bauer ..... F21S 8/037 248/220.1
2012/0032587 A1 * 2/2012 Shih ..... F21S 4/26 315/32
2012/0236554 A1 * 9/2012 Rust ..... H05B 33/0857 362/231
2012/0327658 A1 * 12/2012 Chen ..... H01L 33/62 362/249.06
2013/0039067 A1 * 2/2013 Wong ..... F21V 33/006 362/249.06
2015/0211697 A1 * 7/2015 Packer ..... F21S 4/006 362/555
2015/0292721 A1 * 10/2015 Lesmeister ..... F21V 21/32 362/555
2016/0153644 A1 * 6/2016 Russikoff ..... F21S 4/10 362/396
2016/0238218 A1 * 8/2016 Wang ..... F21L 14/026
2017/0045187 A1 * 2/2017 Li ..... F21S 4/24
2018/0010743 A1 * 1/2018 Nathaniel ..... F21V 3/02
2018/0135818 A1 * 5/2018 Chang ..... F21S 4/15

* cited by examiner

DECORATIVE LIGHTING SYSTEM

This application claims the benefit of the priority of U.S. Provisional Application Patent No. 62/353,691, filed on Jun. 23, 2016, which is incorporated by reference herein in its entirety.

BACKGROUND OF THE INVENTION

Decorative lighting strings are usually used on a few special occasions during the year. Most of the time the lighting strings are in storage in as small a space as possible, typically in a box. Too often, as a result of being thrown in a box, the lighting strings become tangled, which makes reusing then difficult and time consuming. Sleeves for lighting strings have been proposed in the art; however, these are generally difficult to use because they do not adequately secure the ends of the lighting string in the proper position. Also, the prior art sleeves are not suited to be used with the lighting strings inside them as decorative lighting. The need remains in the art for a lighting sleeve that properly and securely positions the ends of the lighting string relative to the sleeve for easy reuse while preventing tangles and for a sleeve that can be used with the lighting string inside it as decorative lighting such that the combined lighting string and sleeve can have enhanced aesthetic appeal.

SUMMARY OF THE INVENTION

The present invention is directed to a sleeve for decorative lighting helps prevent tangled lighting wires. The sleeve has clamps at each end that clamp the lighting wires. The sleeve is flexible and may be elastic. The sleeve may be a light diffuser so that the decorative lighting can be used while in the sleeve. The invention also includes a decorative lighting string that has retractable lights and may be at least stored in the sleeve.

Accordingly, it is an aspect of the present invention to provide a device for holding a lighting string, the lighting string comprising a plurality of lights and a wiring assembly for connecting the plurality of lights to a source of energy for powering the emission of light from the plurality of lights, the wiring assembly having a length and the plurality of lights being distributed along the length of the wiring assembly, the device comprising:

a sleeve having a first end, a second end, a length, an inner space, a first access opening at the first end, and a second access opening at the second end;

a first clamp for holding a portion of the wiring assembly of the lighting string;

a first support structure for supporting the first clamp in proximity to the first access opening, the first clamp being connected to and supported by the first support structure in proximity to the first access opening, the first support structure being attached to the sleeve in proximity to the first access opening;

a second clamp for holding a portion of the wiring assembly of the lighting string; and a second support structure for supporting the second clamp in proximity to the second access opening, the second clamp being connected to and supported by the second support structure in proximity to the second access opening, the second support structure being attached to the sleeve in proximity to the second access opening, wherein the sleeve is capable of receiving the plurality of lights and a portion of the wiring assembly supporting the plurality of lights in the inner space of the sleeve, wherein the first clamp clamps a first clamped portion of the wiring assembly, wherein the second clamp clamps a second clamped portion of the wiring assembly, and wherein the portion of the wiring assembly supporting the plurality of lights is intermediate the first clamped portion of the wiring assembly and the second clamped portion of the wiring assembly to thereby secure the plurality of lights and the portion of the wiring assembly supporting the plurality of lights in the inner space of the sleeve.

It is another aspect of the present invention to provide a device incorporating any of the aspects of the present invention described herein, wherein the sleeve is made of a flexible material.

It is still another aspect of the present invention to provide a device incorporating any of the aspects of the present invention described herein, wherein the sleeve is made of a resilient material.

It is yet another aspect of the present invention to provide a device incorporating any of the aspects of the present invention described herein, wherein the sleeve is made of an elastic material such that the sleeve has a relatively shorter unstressed length, but is extensible such that it can be stretched to a longer stretched length by application of a stretching force, wherein the sleeve returns to its unstressed length when the stretching force is removed.

It is yet another aspect of the present invention to provide a device incorporating any of the aspects of the present invention described herein, wherein the portion of the wiring assembly supporting the plurality of lights has a length and wherein the stretched length is at least as long as the length of the portion of the wiring assembly supporting the plurality of lights.

It is yet another aspect of the present invention to provide a device incorporating any of the aspects of the present invention described herein, wherein the sleeve is made of thermoplastic elastomer (TPE).

It is yet another aspect of the present invention to provide a device incorporating any of the aspects of the present invention described herein, wherein the sleeve has perforations or openings distributed over its surface.

It is yet another aspect of the present invention to provide a device incorporating any of the aspects of the present invention described herein, wherein the sleeve acts as a light diffuser when one or more of the plurality of lights is turned on.

It is yet another aspect of the present invention to provide a device incorporating any of the aspects of the present invention described herein, wherein the sleeve is made of a woven mesh or netting.

It is yet another aspect of the present invention to provide a device incorporating any of the aspects of the present invention described herein, wherein the sleeve is made of a transparent or translucent material.

It is yet another aspect of the present invention to provide a device incorporating any of the aspects of the present invention described herein, wherein the sleeve is made of a woven fabric.

It is yet another aspect of the present invention to provide a device incorporating any of the aspects of the present invention described herein, wherein the sleeve has perforations that allow light from the plurality of lights to shine or pass through the sleeve.

It is yet another aspect of the present invention to provide a device incorporating any of the aspects of the present invention described herein, wherein the sleeve is flexible and the lights can operate while inside the sleeve, wherein the sleeve acts as a diffuser allowing light from the plurality of lights to shine or pass through the sleeve such that the lights can be used for decorative purposes while inside the sleeve.

It is yet another aspect of the present invention to provide a device incorporating any of the aspects of the present invention described herein, wherein the first clamp and the second clamp are spring loaded and each has at least one respective spring such that they each exert a clamping force on the wiring assembly when each is engaged to the wiring assembly and that the clamping force is provided by the at least one respective spring for each of the first clamp and the second clamp.

It is yet another aspect of the present invention to provide a device incorporating any of the aspects of the present invention described herein, further comprising a lighting string comprising:

a plurality of lights; and a wiring assembly for connecting the plurality of lights to a source of energy for powering the emission of light from the plurality of lights, the wiring assembly having a length and the plurality of lights being distributed along the length of the wiring assembly, wherein each of the plurality of lights is retractable and moves between a retracted position and a deployed position.

It is yet another aspect of the present invention to provide a device incorporating any of the aspects of the present invention described herein, wherein at least one of the first clamp and the second clamp supports a camming surface in proximity to a corresponding access opening of the sleeve, and each of the plurality of lights has a cam follower that engages the camming surface as each of the lights is withdrawn from the sleeve such that each of the lights is moved from its retracted position to its deployed position as each of the lights is pulled out of the sleeve.

It is yet another aspect of the present invention to provide a device incorporating any of the aspects of the present invention described herein, wherein each of the first support structure and the second support structure comprises a funnel-shaped portion to ease the insertion of the lighting string into the sleeve.

It is yet another aspect of the present invention to provide a device incorporating any of the aspects of the present invention described herein, wherein each of the funnel-shaped portion of the first support structure and the funnel-shaped portion of the second support structure has an inner end and wherein the inner end of the funnel-shaped portion of the first support structure and the inner end of the funnel-shaped portion of the second support structure are engageable to each other to ease passage of one end of the lighting string completely through the entire sleeve.

It is yet another aspect of the present invention to provide a device incorporating any of the aspects of the present invention described herein, wherein each of the funnel-shaped portion of the first support structure and the funnel-shaped portion of the second support structure is segmented with each having a plurality of segments that are arranged in telescoping fashion such that each of the funnel-shaped portion of the first support structure and the funnel-shaped portion of the second support structure is collapsible and can be placed in a collapsed configuration and an extended configuration, and wherein each of the funnel-shaped portion of the first support structure and the funnel-shaped portion of the second support structure is more compact in the collapsed configuration so as to minimize interference with functioning of the sleeve.

It is yet another aspect of the present invention to provide a decorative lighting string comprising:

a plurality of lights; and a wiring assembly for connecting the plurality of lights to a source of energy for powering the emission of light from the plurality of lights, the wiring assembly having a length and the plurality of lights being distributed along the length of the wiring assembly, wherein each of the plurality of lights is retractable and moves between a retracted position and a deployed position.

It is yet another aspect of the present invention to provide a device incorporating any of the aspects of the present invention described herein, wherein the sleeve is flexible and expandable and the lights can operate while inside the sleeve, wherein the sleeve acts as a diffuser allowing light from the plurality of lights to shine or pass through the sleeve such that the lights can be used for decorative purposes while inside the sleeve.

These and other aspects and advantages of the present invention will be further elucidated by the following Detailed Description, drawing figures, and Claims.

BRIEF DESCRIPTION OF THE DRAWING FIGURES

The attached drawings show embodiments of the invention in the several views.

DETAILED DESCRIPTION

Figure 1:
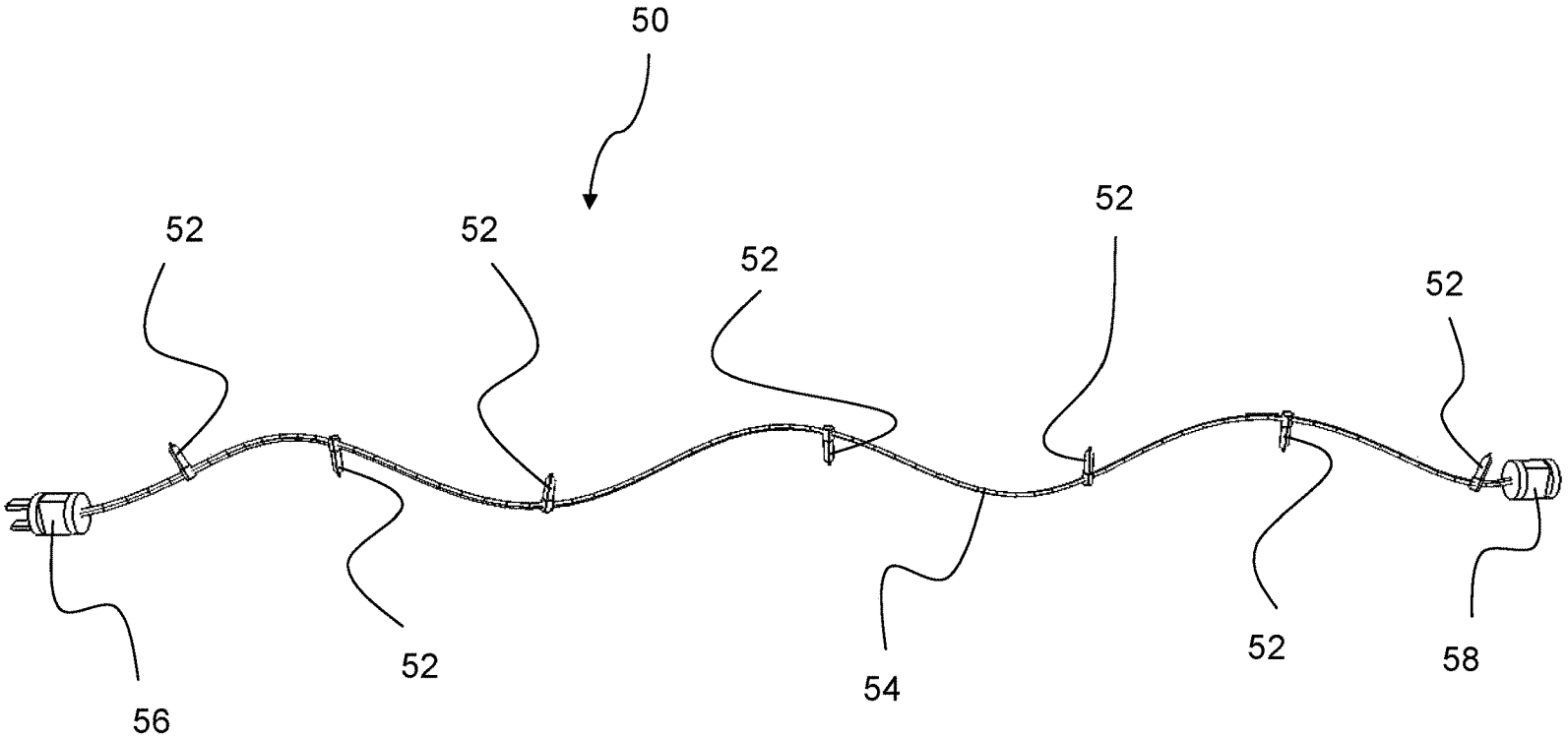
FIGS. 1-3 show a lighting string useful for the lighting sleeve device of the present invention.
Figure 2:
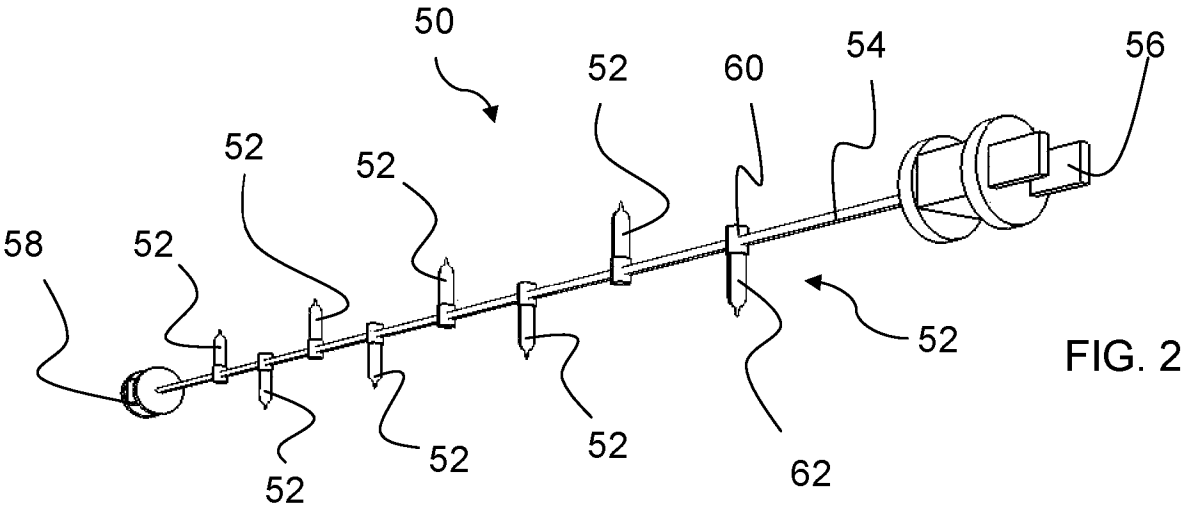
Figure 3:
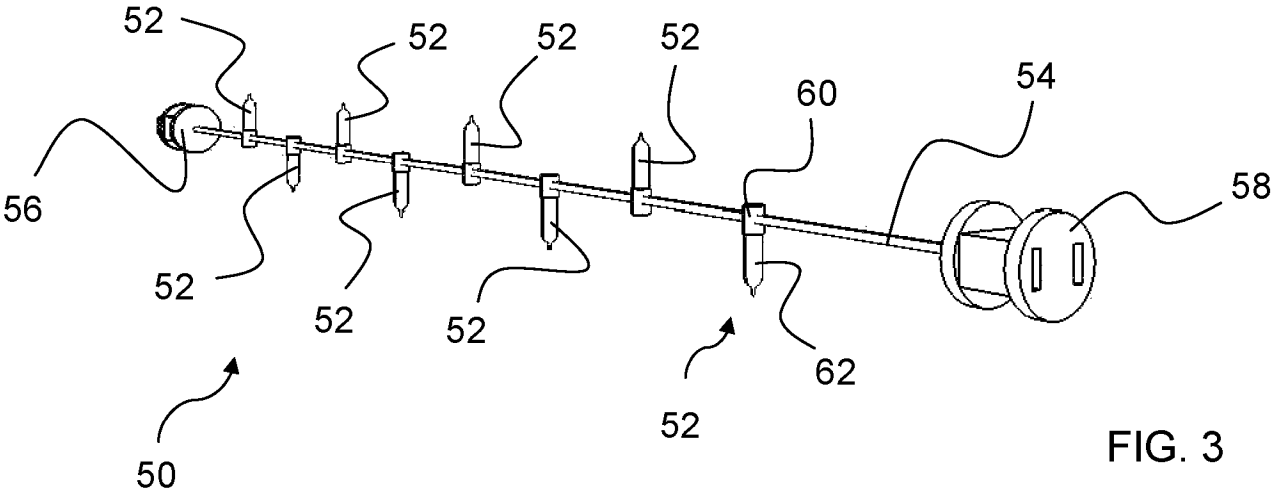
Figure 4:
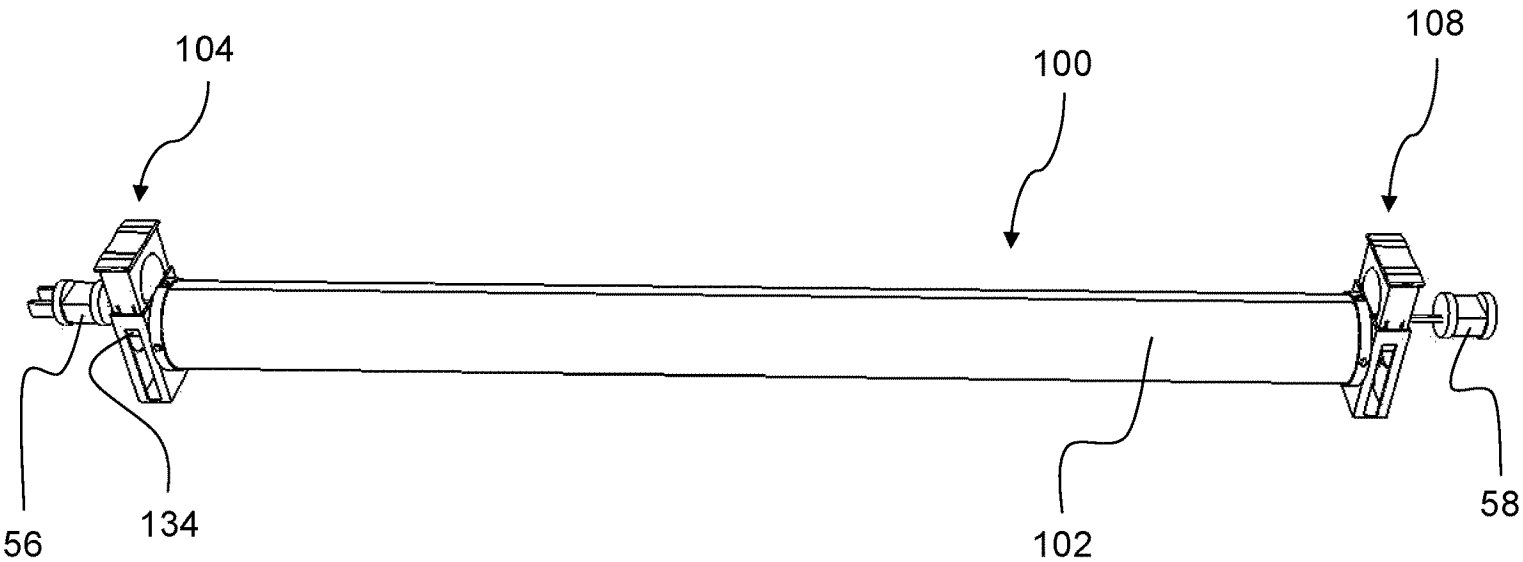
FIGS. 4-7 show a first embodiment of the lighting sleeve device of the present invention; the sleeve and support structures being sectioned in some views to reveal internal detail.
Figure 5:
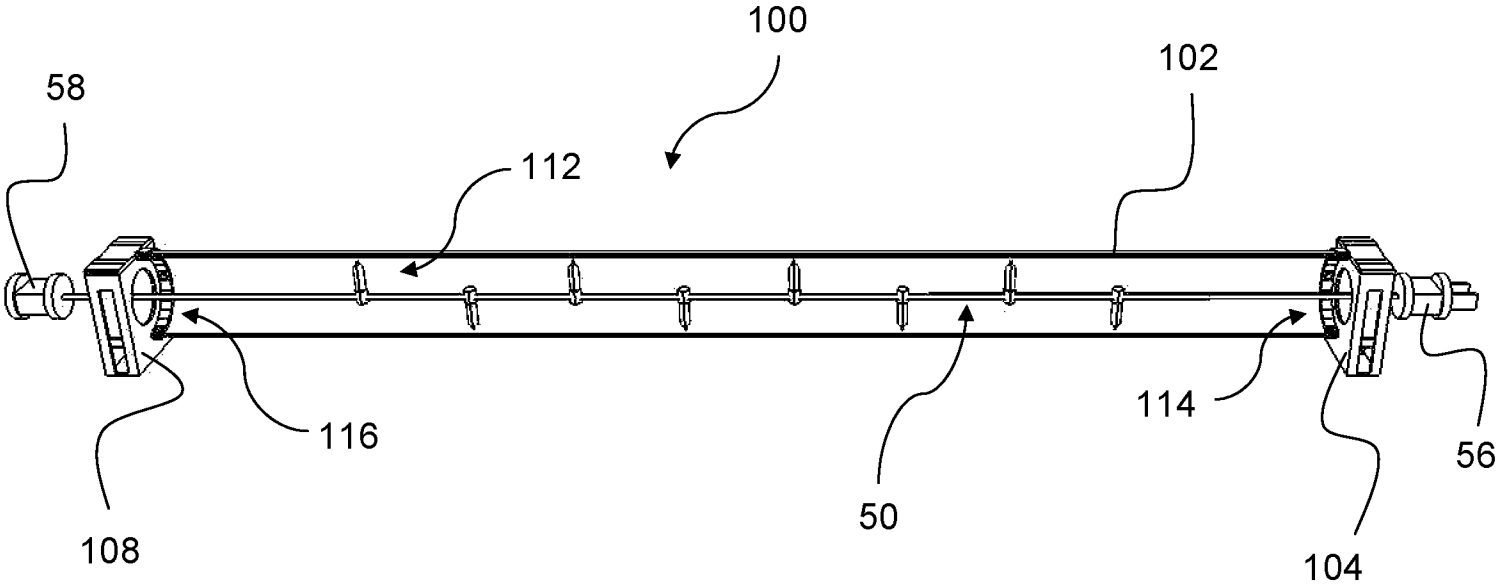
Figure 6:
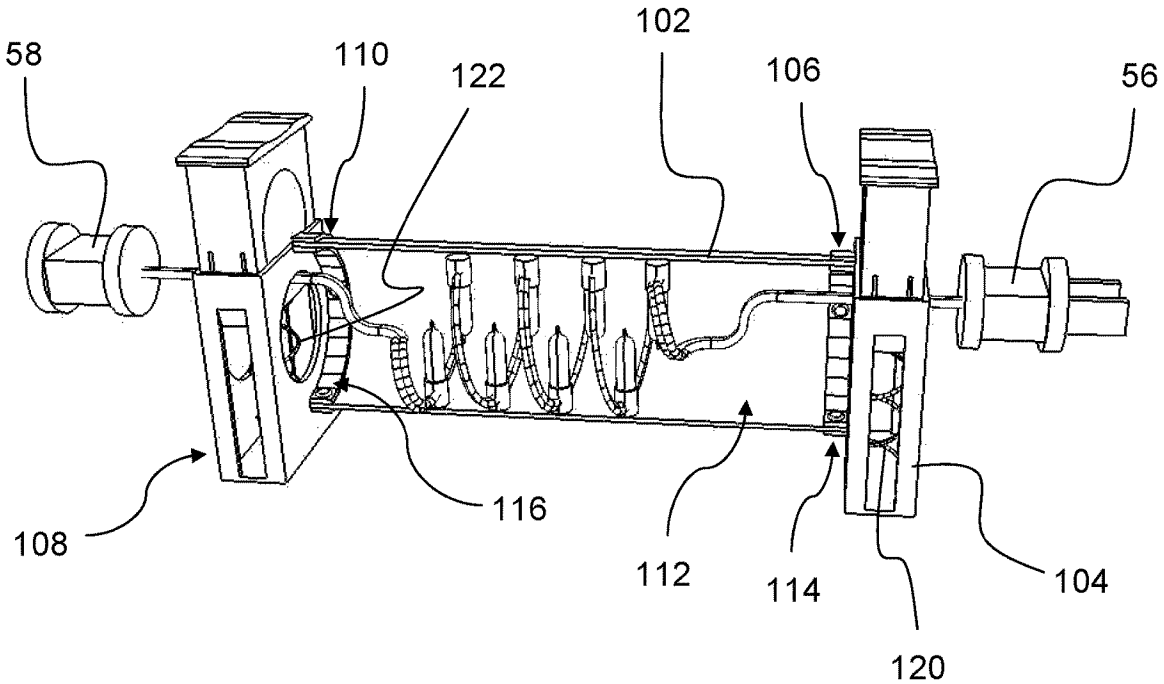
Figure 7:
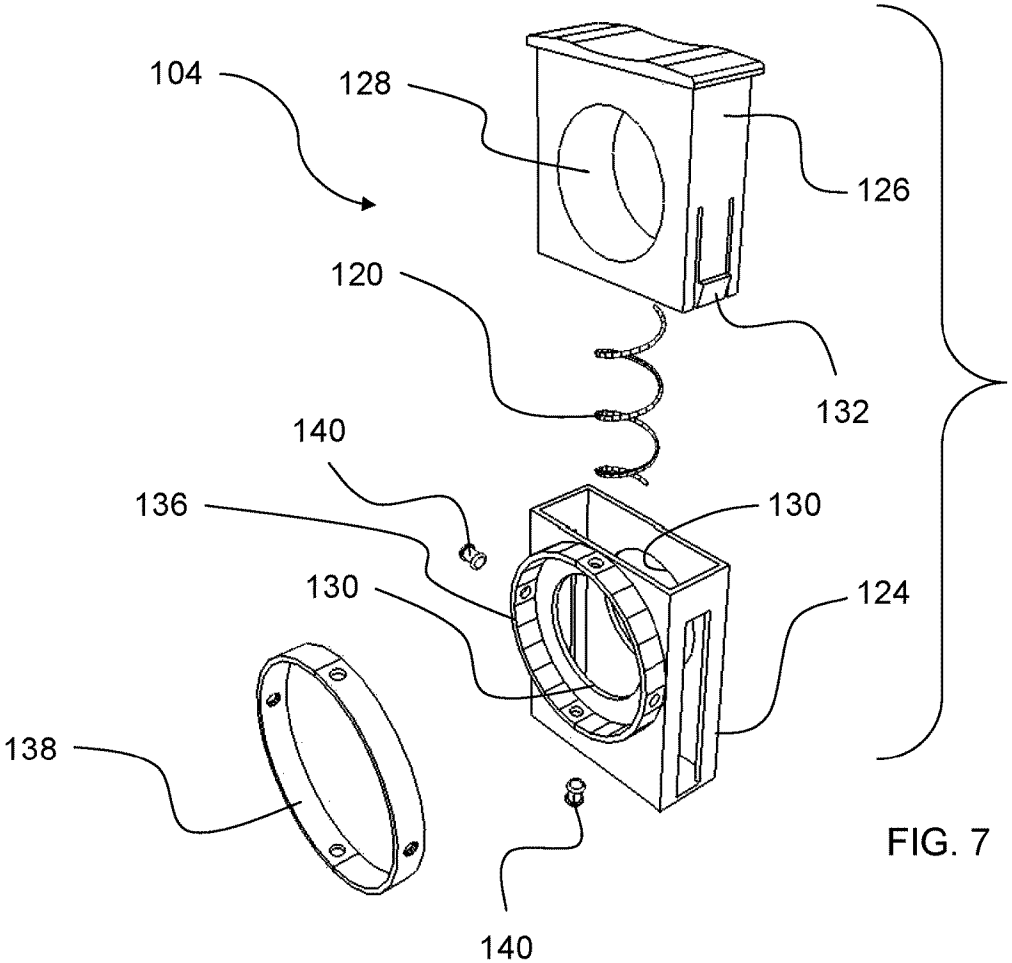

Referring to FIGS. 1-3, a typical string of decorative lights 50, sometimes referred to as Christmas tree lights, can be seen. The lighting string 50 includes a plurality of lights 52 and a wiring assembly 54 for connecting the plurality of lights to a source of energy for powering the emission of light from the plurality of lights. The wiring assembly 54 has a length and the plurality of lights 52 are distributed along the length of the wiring assembly 54. Typically, there is an electrical connector at each end of the wiring assembly 54. Commonly, the electrical connector at one end of the wiring assembly 54 is a male connector 56 and the electrical connector at the other end of the wiring assembly 54 is a female connector 58. This arrangement allows the lighting string 50 to be connected to a source of electrical power and/or to other lighting strings to form larger, more expansive arrangements of decorative lighting. Each light 52 of the plurality of lights is in fact a light assembly including a miniature socket 60 and a miniature bulb 62.

Referring to FIGS. 4-13, a first embodiment 100 of the present invention can be seen. The lighting sleeve device 100 includes a sleeve 102, a first clamp 104, first support structure 106, a second clamp 108, and a second support structure 110. The sleeve 102 has having a first end, a second end, a length, an inner space 112, a first access opening 114 at the first end, and a second access opening 116 at the second end. The first clamp 104 is for holding a portion of the wiring assembly 54 of the lighting string 50 such that one of the end portions of the lighting string 50 can be securely held at a fixed location proximate the first access opening 114. The first support structure 106 supports the first clamp 104 in proximity to the first access opening 114. The first clamp 104 is connected to and supported by the first support structure 106 in proximity to the first access opening 114. The first support structure 106 is attached to the sleeve 102 in proximity to the first access opening 114.

The second clamp 108 is for holding a portion of the wiring assembly 54 of the lighting string 50 such that one of the end portions of the lighting string 50 can be securely held at a fixed location proximate the second access opening 116. The second support structure 110 supports the second clamp 108 in proximity to the second access opening 116. The second clamp 108 is connected to and supported by the second support structure 110 in proximity to the second access opening 116. The second support structure 110 is attached to the sleeve 102 in proximity to the second access opening 116.

The sleeve is sized so as to be capable of receiving the plurality of lights 52 and a portion of the wiring assembly 54 supporting the plurality of lights 52 in the inner space of the sleeve 102. The first clamp 104 clamps a first clamped portion of the wiring assembly 54, which typically would be near the male connector 56. The second clamp 108 clamps a second clamped portion of the wiring assembly 54, which typically would be near the female connector 58. The portion of the wiring assembly 54 supporting the plurality of lights 52 is intermediate the first clamped portion of the wiring assembly and the second clamped portion of the wiring assembly to thereby secure the plurality of lights 52 and the portion of the wiring assembly 54 that supports the plurality of lights 52 in the inner space or interior of the sleeve 102. Preferably, the sleeve 102 is made of a flexible material such that the sleeve 102 is itself flexible.

Also, in some preferred embodiments, the sleeve 102 is made of a resilient material. By "resilient" it is meant that the material is stretchable or expandable, but tends to return to its original shape when unstressed. In such embodiments, the sleeve 102 may be made of an elastic material such that the sleeve 102 has a relatively shorter unstressed length, but is extensible such that it can be stretched to a longer stretched length by application of a stretching force. In these embodiments, the sleeve 102 returns to its unstressed length when the stretching force is removed. Preferably, in such embodiments, the stretched length of the sleeve 102 is at least as long as the length of the portion of the wiring assembly 54 that supports the plurality of lights 52. Preferably, in such embodiments, the sleeve is made of thermoplastic elastomer (TPE).

Figure 8:
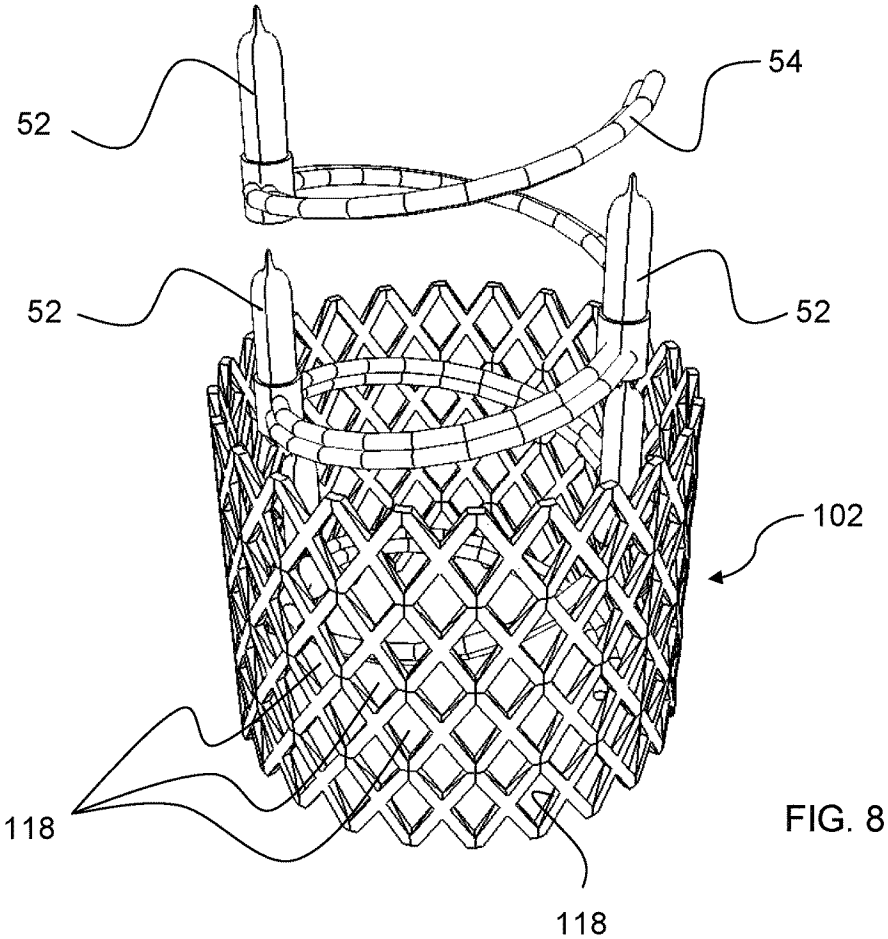
FIGS. 8-9 illustrate foraminous material for use in the sleeve of the lighting sleeve device of the present invention.
Figure 9:
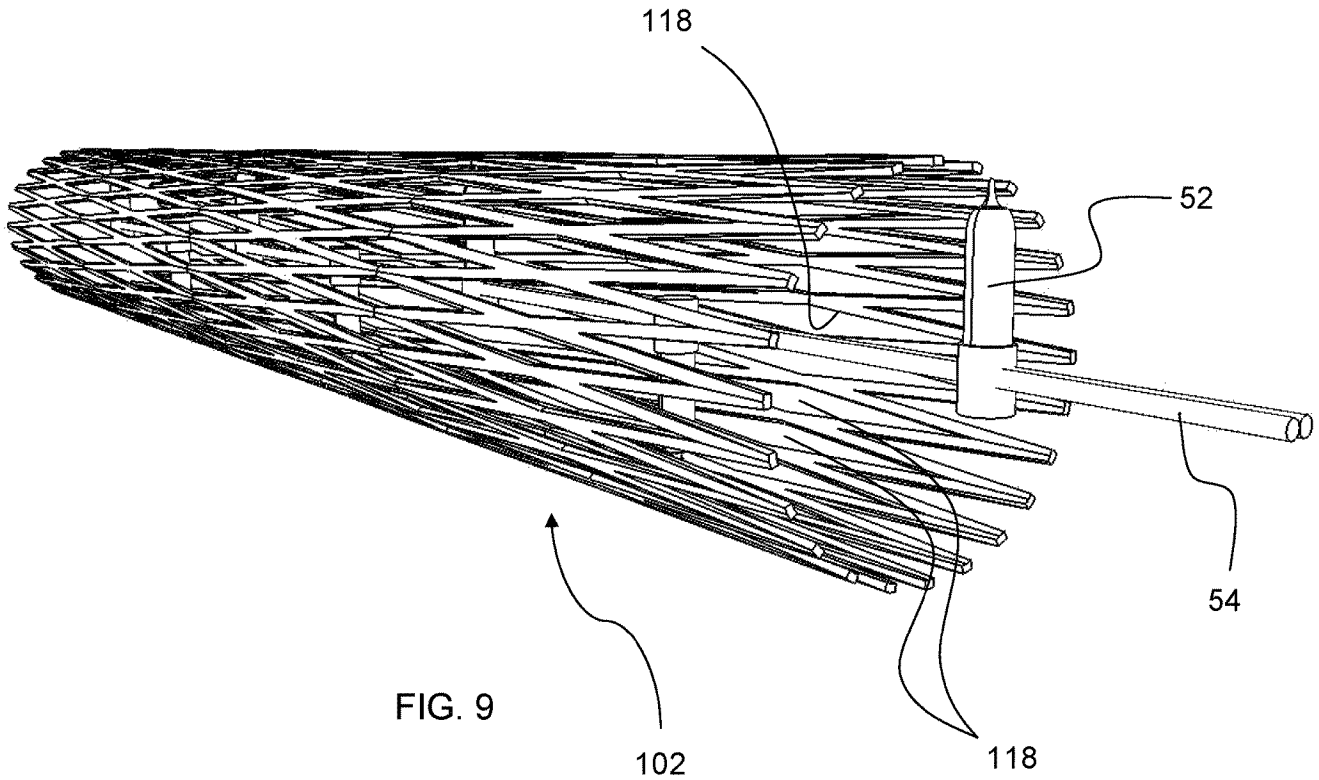
Figure 10:
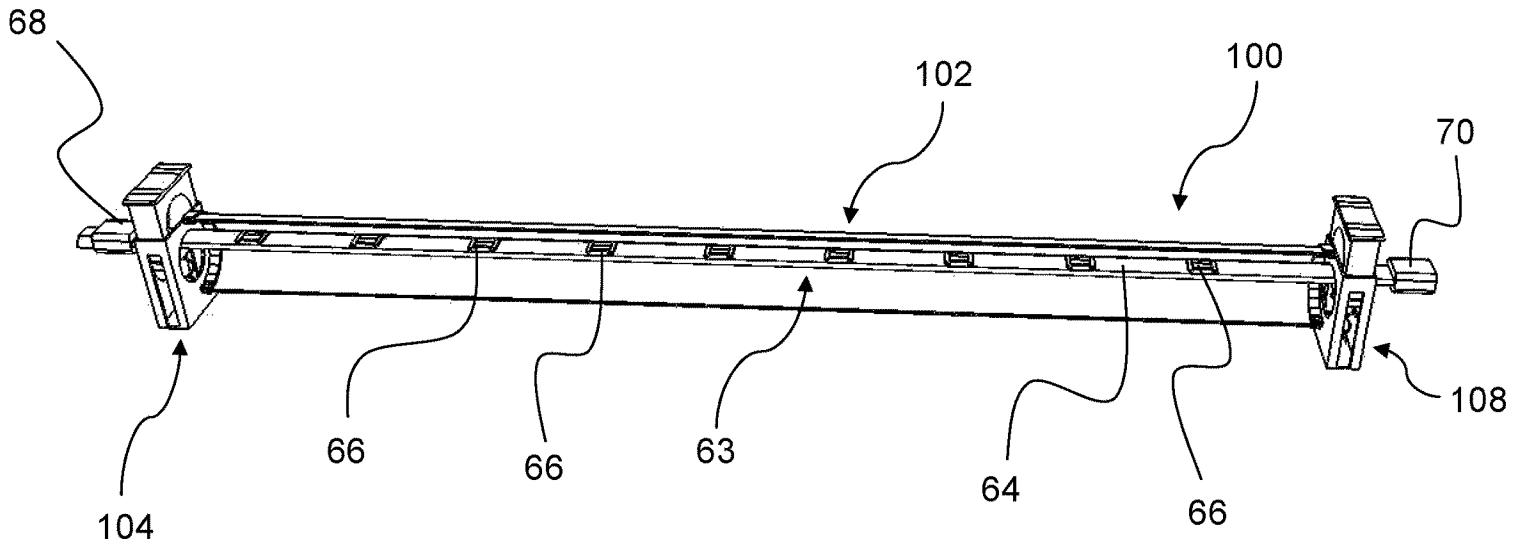
FIGS. 10-13 show the first embodiment of the lighting sleeve device of the present invention being used with a lighting string having light emitting diode (LED) lights.
Figure 11:
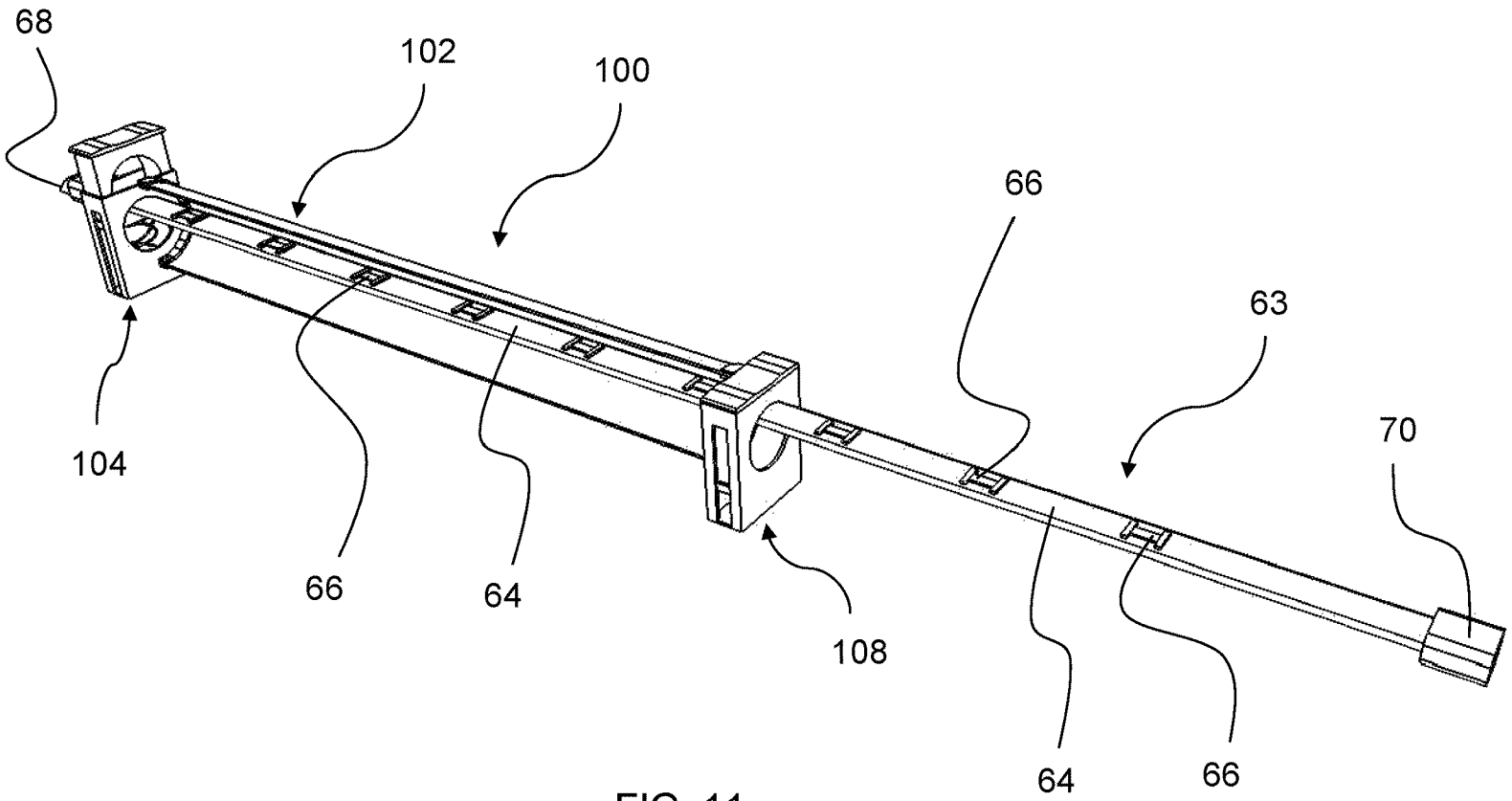
Figure 12:
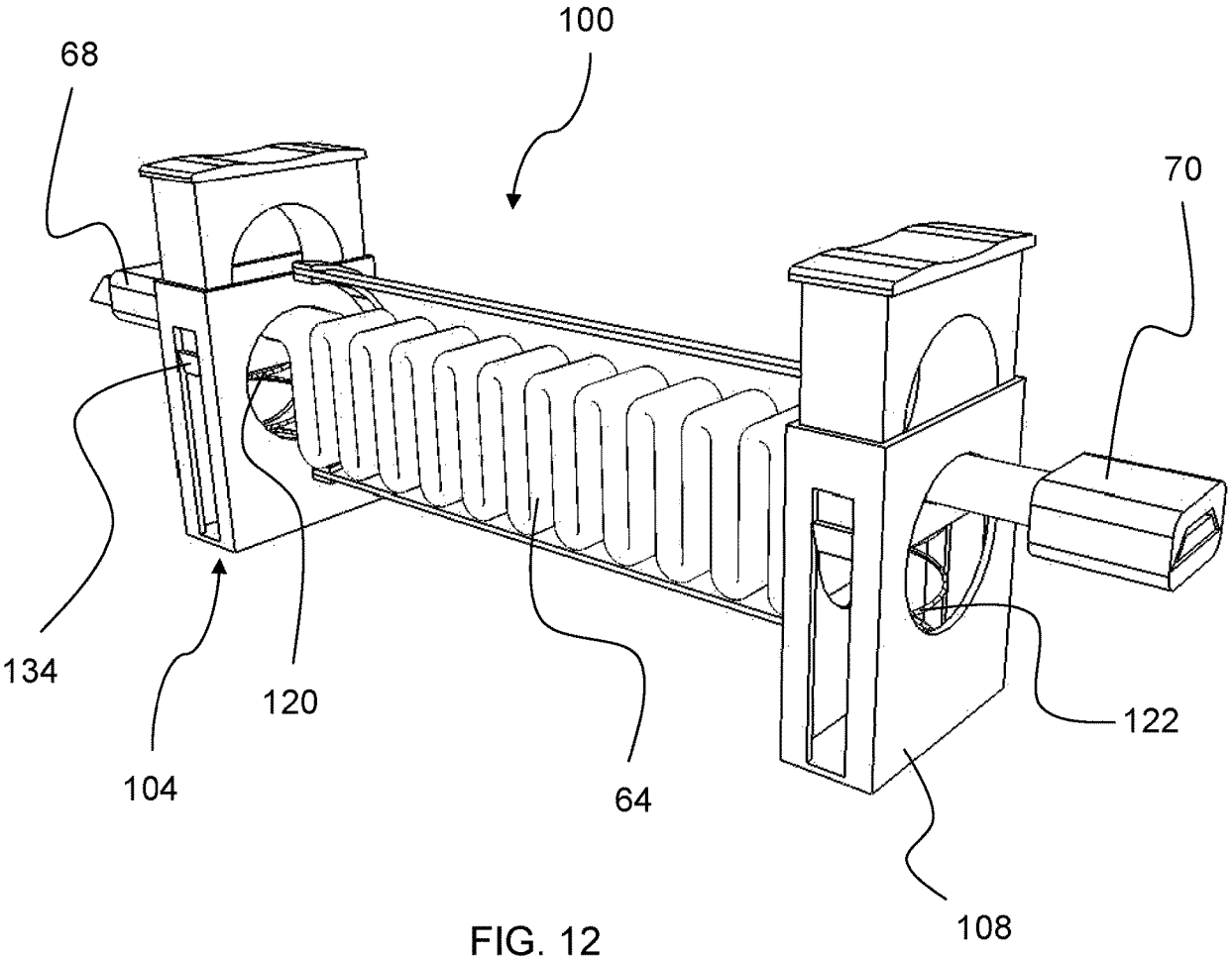
Figure 13:
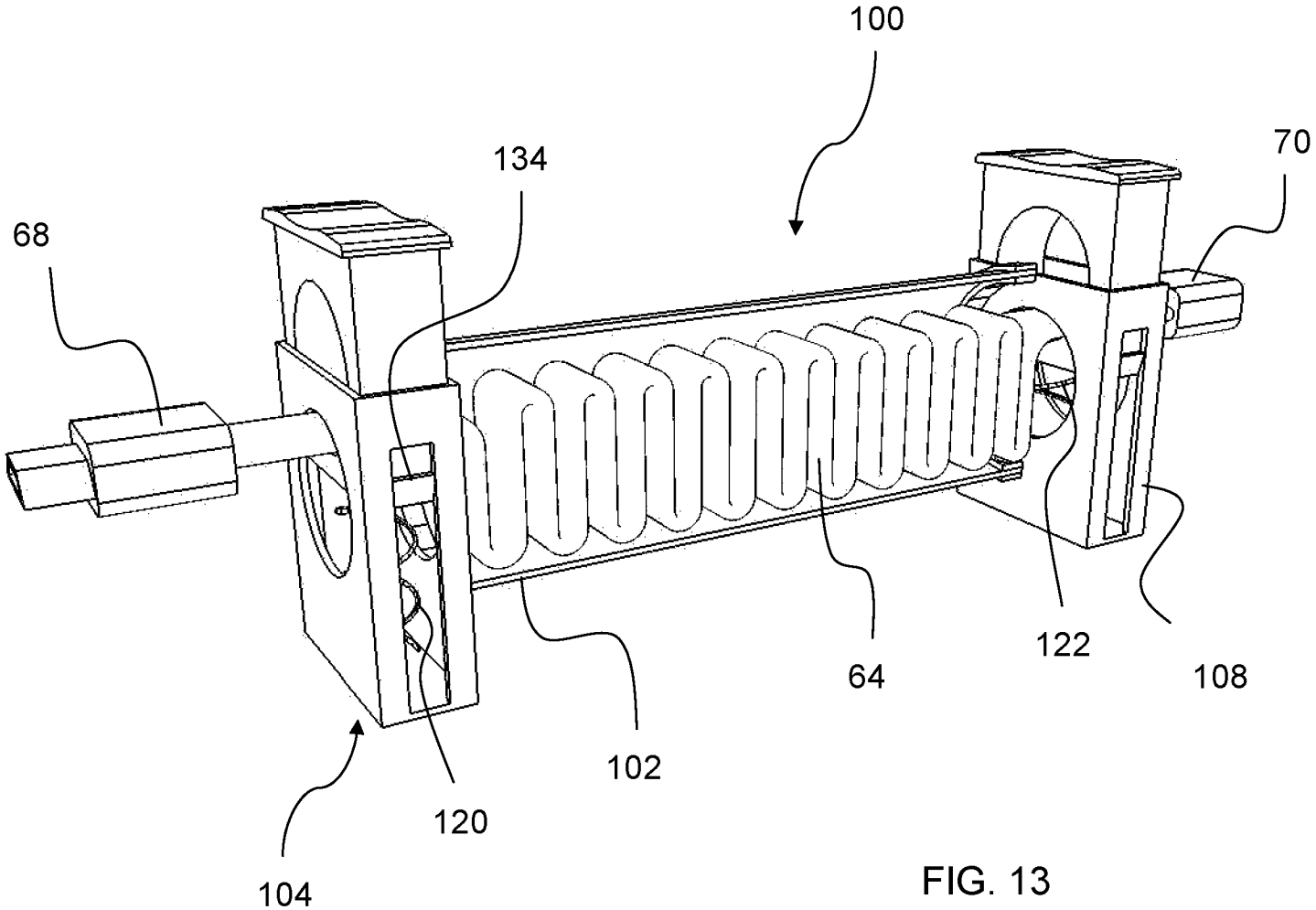
Figure 14:
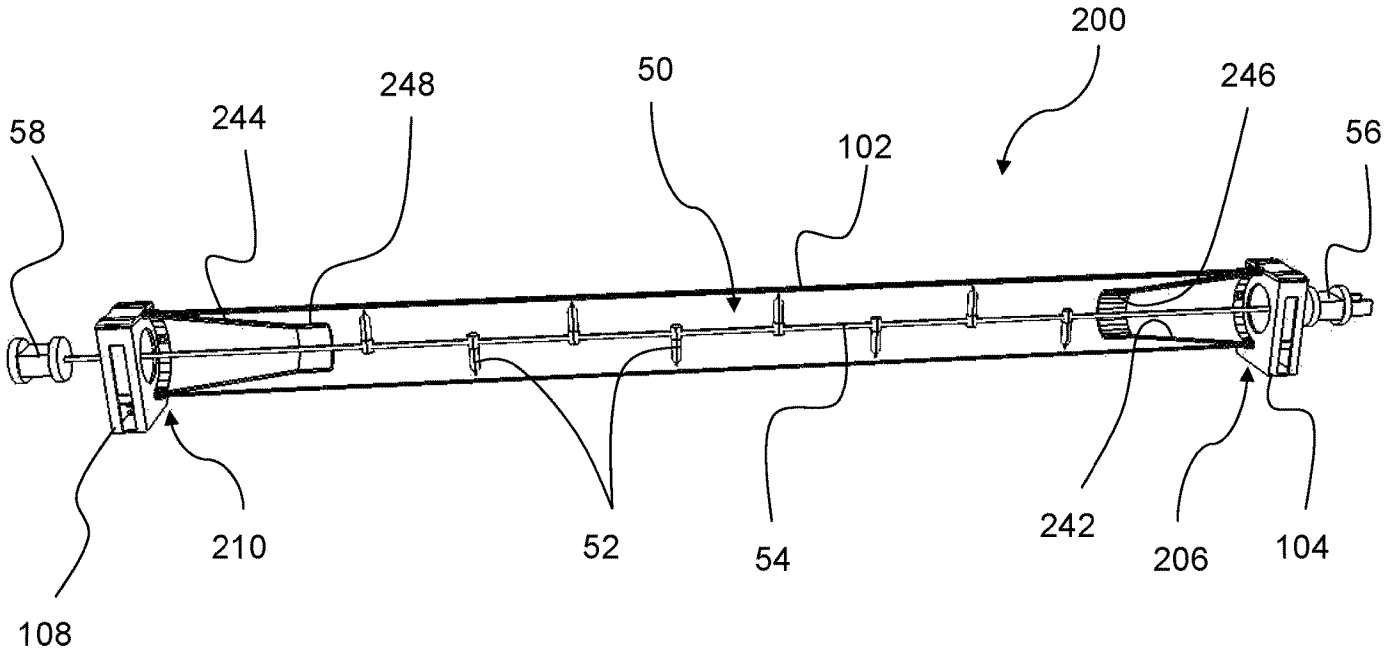
FIGS. 14-18 show a second embodiment of the lighting sleeve device of the present invention having support structures that include funnel-shaped portions; the sleeve and support structures are sectioned in some views to reveal internal detail.
Figure 15:
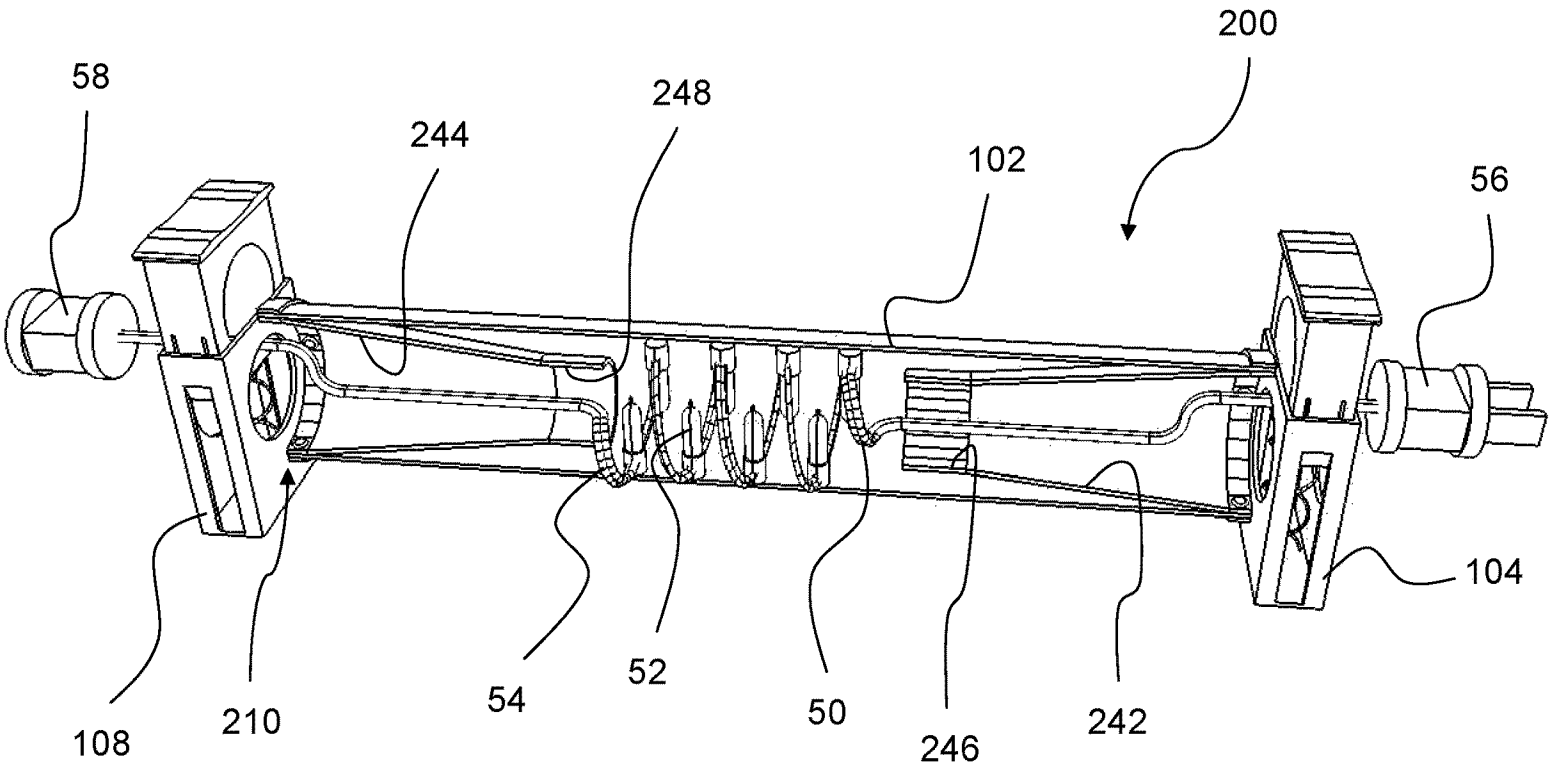
Figure 16:
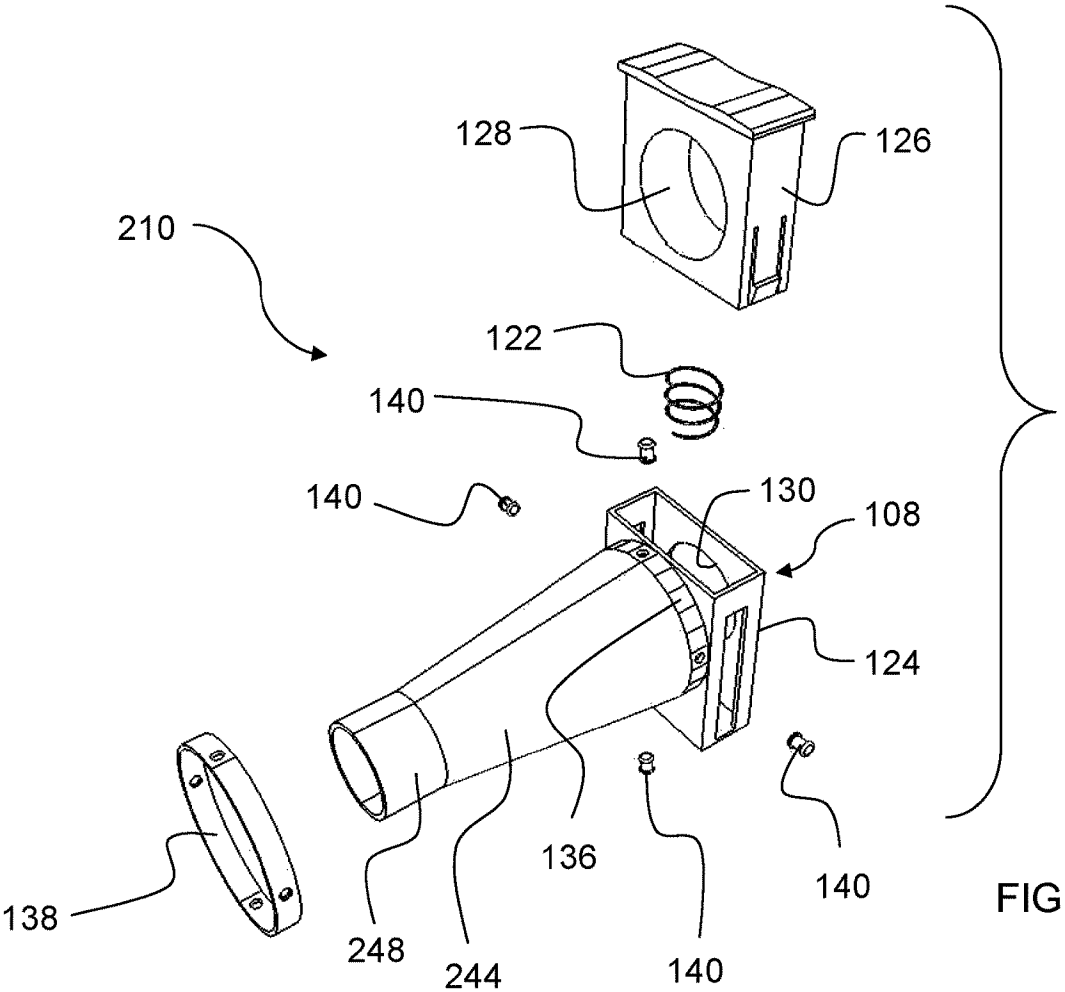
Figure 17:
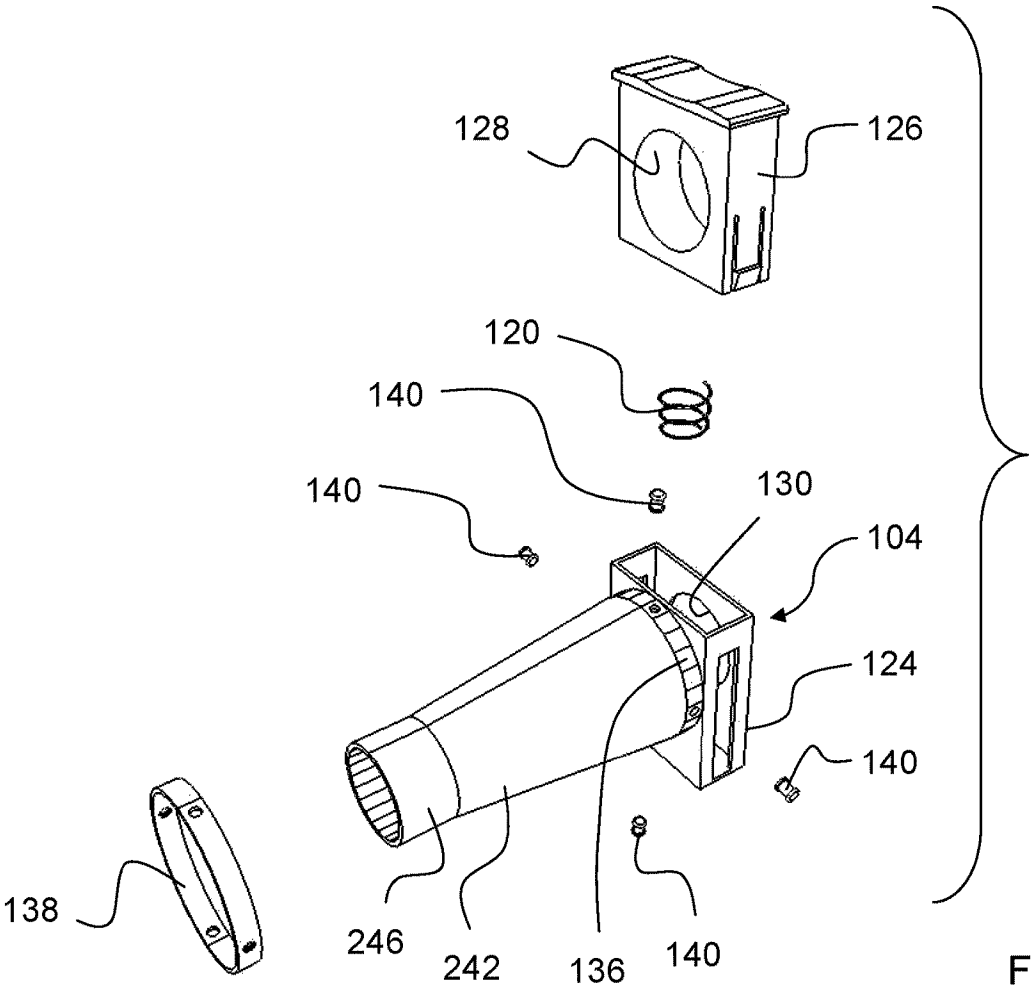

In some embodiments, including those with stretchable sleeves 102, the sleeve 102 is foraminous. In other words, the sleeve 102 has perforations or openings 118 distributed over its surface that penetrate through the thickness of the sleeve from its outer surface to its inner surface. The perforations 118 allow light from the plurality of lights 52 to shine or pass through the sleeve 102. Examples of perforations 118 are diagrammatically illustrated in FIGS. 8 and 9, which show portions of sleeves 102. FIG. 9 shows the perforated sleeve 102 in stretched form, while FIG. 8 shows the perforated or foraminous sleeve 102 in un-stretched or unstressed form. FIG. 8 also applies to simply flexible, foraminous sleeves 102. The sleeve 102 can be made of a woven mesh or netting, which would then provide the perforations 118. Alternatively, the perforations may be made by perforating a woven material or a non-woven material, which may, for example, be a uniform or solid, flexible material.

Preferably, the sleeve 102 acts as a light diffuser when one or more of the plurality of lights 52 is turned on. This can be achieved in a variety of ways. The sleeve 102 can be made of a transparent or translucent material, or the sleeve 102 may have perforations or openings 118 distributed over its surface as previously described, or a combination of these may be employed.

The sleeve 102 may be made of a woven fabric. In some embodiments, the woven fabric may be sufficiently porous to allow enough light to shine or pass through the sleeve 102 so as to allow the sleeve 102 to act as a diffuser and to provide an aesthetically pleasing decorative effect when the lights 52 are turned on.

Preferably, the lights 52 can operate while inside the sleeve 102, and the sleeve 102 acts as a diffuser allowing light from the plurality of lights 52 to shine or pass through the sleeve 102 such that the lights 52 can be used for decorative purposes while inside the sleeve 102.

The first clamp 104 and the second clamp 108 are spring loaded and each has at least one respective spring 120 and 122 such that they each exert a clamping force on the wiring assembly 54 when each is engaged to the wiring assembly. The springs 120 and 122 provide the clamping force exerted by the first clamp 104 and the second clamp 108, respectively, on the wiring assembly 54.

In the lighting sleeve device 100, the clamps 104 and 108 and the support structures 106 and 110 are identical. Accordingly, only the first clamp 104 and the first support structure 106 are described in detail, it being understood that the second clamp 108 and the second support structure 110 are identical to the first clamp 104 and the first support structure 106.

The clamp 104 includes a body 124, a spring 120, and a plunger 126. The body 124 has cavity that receives at least a portion of the plunger 126 and supports the plunger 126 for rectilinear or sliding movement between an extended position and a retracted position relative to the body 124. The plunger 126 and the body 124 have openings 128 and 130 that align when the plunger 126 is in the retracted position allowing the connectors and other portions of the lighting string 50 to pass through the openings in the plunger and the clamp body. When the plunger 126 is released, the spring 120 urges the plunger to the extended position. If a portion of the wiring assembly 54 is in the openings in the plunger and the clamp body when the plunger is released, the spring 120 urges the plunger 126 into engagement with the wiring portion, which in turn urges the wiring portion into engagement with the clamp body 124 and clamps the wiring portion between the sides of the openings in the plunger and the clamp body by spring force. Snap legs 132 and 134 engage slots in the clamp body 124 to prevent the plunger 126 from being ejected from the clamp body 124 by spring 120 when the clamp 104 is not in use.

The support structure 106 includes an inner ring 136 and an outer ring 138. The inner ring 136 is attached to the clamp body 124; in the illustrated example, the two are of integral construction. A portion of the sleeve 102 adjacent the end opening 114 of the sleeve fits over the inner ring 136. The outer ring 138 fits over the portion of the sleeve 102 adjacent the end opening 114 of the sleeve. The inner ring 136 and the outer ring 138 each have holes that register with corresponding holes in the other. Rivets 140 pass through the holes in the inner ring 136 and the outer ring 138 and the sleeve 102 to attach the support structure 106 to the end portion of the sleeve 102 with the opening 130 in the clamp body 124 being in alignment with the end opening 114.

In use, one end of the lighting string 50 is passed completely through the lighting sleeve device such that one end connector 56 or 58 is near a respective clamp 104 or 108 with the lighting sleeve device being positioned intermediate the connectors 56 and 58. The clamp near one of the end connectors is then released, which clamps a portion of the wiring 54 near that connector. The other clamp is then moved toward the other connector 56 or 58 while the plunger is being pressed to the retracted position. Thus, the sleeve 102 is pulled over the lights 52 and most of the wiring 54. When the other clamp is near its respective connector 56 or 58, its plunger is released thereby clamping the wiring 54 near the respective connector and securely capturing most of the lighting string within the sleeve 102. The sleeve 102 is then allowed to contract under its own elasticity, or rolled up depending on sleeve type, to place the lighting string in storage. The clamps 104 and 108 can be set on hooks using their openings 130 to use the lighting string and the lighting sleeve device together, while the lighting string 50 is inside the lighting sleeve device 100, as decorative lighting. Alternatively, other attachment points may be provided on the clamps or support structure for this purpose.

Referring to FIGS. 10-13, the lighting sleeve device 100 is seen in use with a lighting string 63 that is of the type having a wiring strip 64 supporting LED lights 66 and having male and female connectors 68 and 70, respectively.

Referring to FIGS. 14-18, a second embodiment 200 of the lighting sleeve device of the present invention can be seen. The device 200 is essentially identical to the lighting sleeve device 100 except for having funnel-shaped portions 242 and 244 as part of the first and second support structures 206 and 210. In the interest of brevity, only the differences between the lighting sleeve devices 100 and 200 are discussed in detail.

Figure 18:
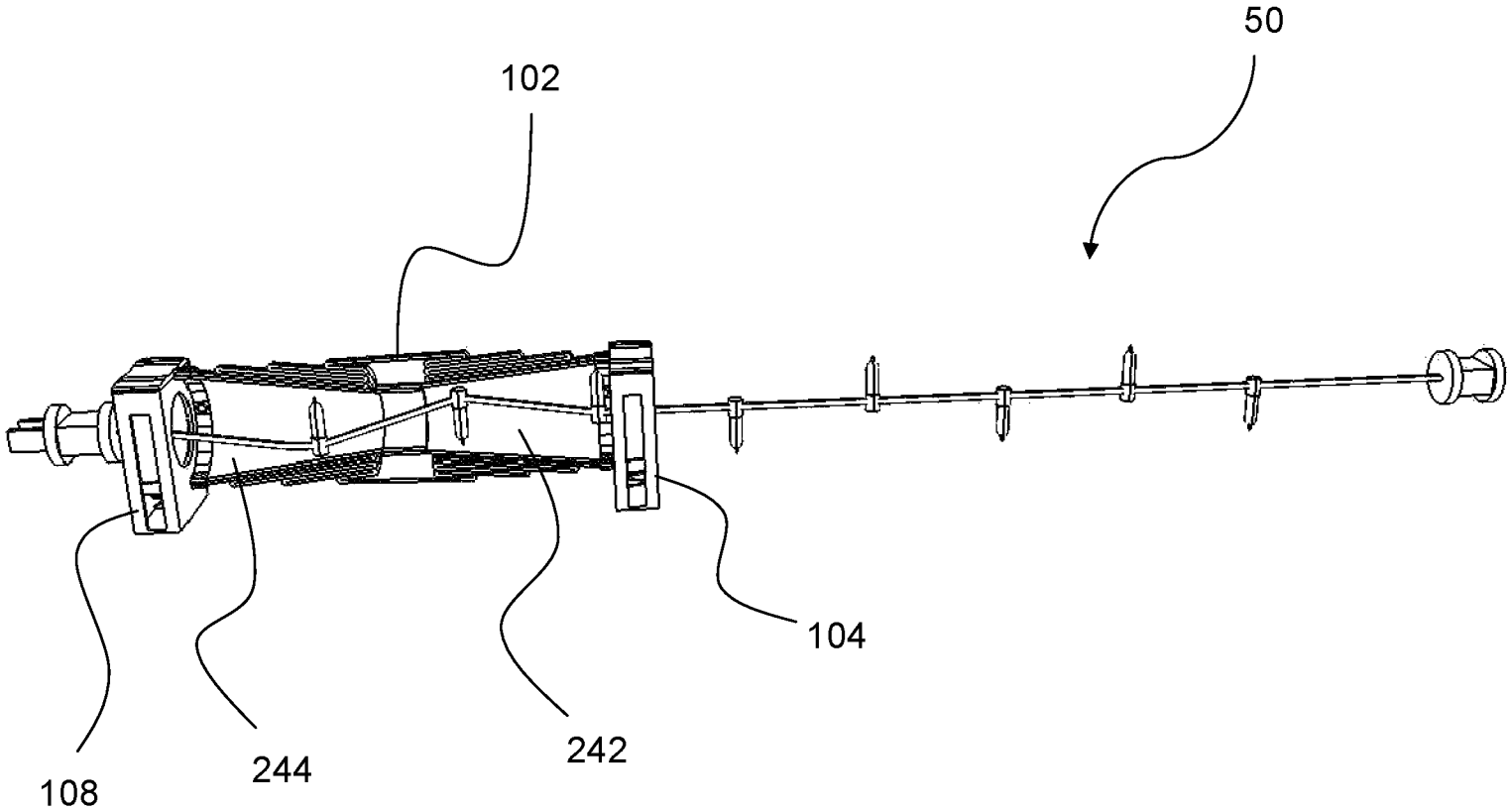

Each of the first support structure 206 and the second support structure 210 comprises a funnel-shaped portion 242 and 244, respectively, to ease the insertion of the lighting string 50 into the sleeve 102. Each of the funnel-shaped portion 242 of the first support structure 206 and the funnel-shaped portion 244 of the second support structure 210 has an inner end 246 and 248, respectively. The inner end of the funnel-shaped portion 242 of the first support structure 206 and the inner end of the funnel-shaped portion 244 of the second support structure 210 are engageable to each other to ease passage of one end of the lighting string 50 completely through the entire sleeve 102 and the entire lighting sleeve device 200. The engagement is illustrated in FIG. 18 with the inner end of the second funnel-shaped portion 244 fitting inside the inner end of the first funnel-shaped portion 242. Alternatively, the inner end of the second funnel-shaped portion 244 can be provided with radially outward projecting pegs and the inner end of the first funnel-shaped portion 242 can be provided with L-shaped slots, having longitudinal and circumferential portions, to receive those pegs so that the funnel-shaped portions can be locked together by relatively rotating them after the inner end of the second funnel-shaped portion 244 is inserted into the inner end of the first funnel-shaped portion 242.

FIG. 18 also illustrates how the first funnel-shaped portion 242 and the second funnel-shaped portion 244 can be used to assist in folding a flexible-type tubular sleeve 102 over on itself multiple times to bring the funnel-shaped portions together. The first funnel-shaped portion 242 and the second funnel-shaped portion 244 are attached to the inner rings 136 of the support structures 206 and 210, respectively.

Figure 19:
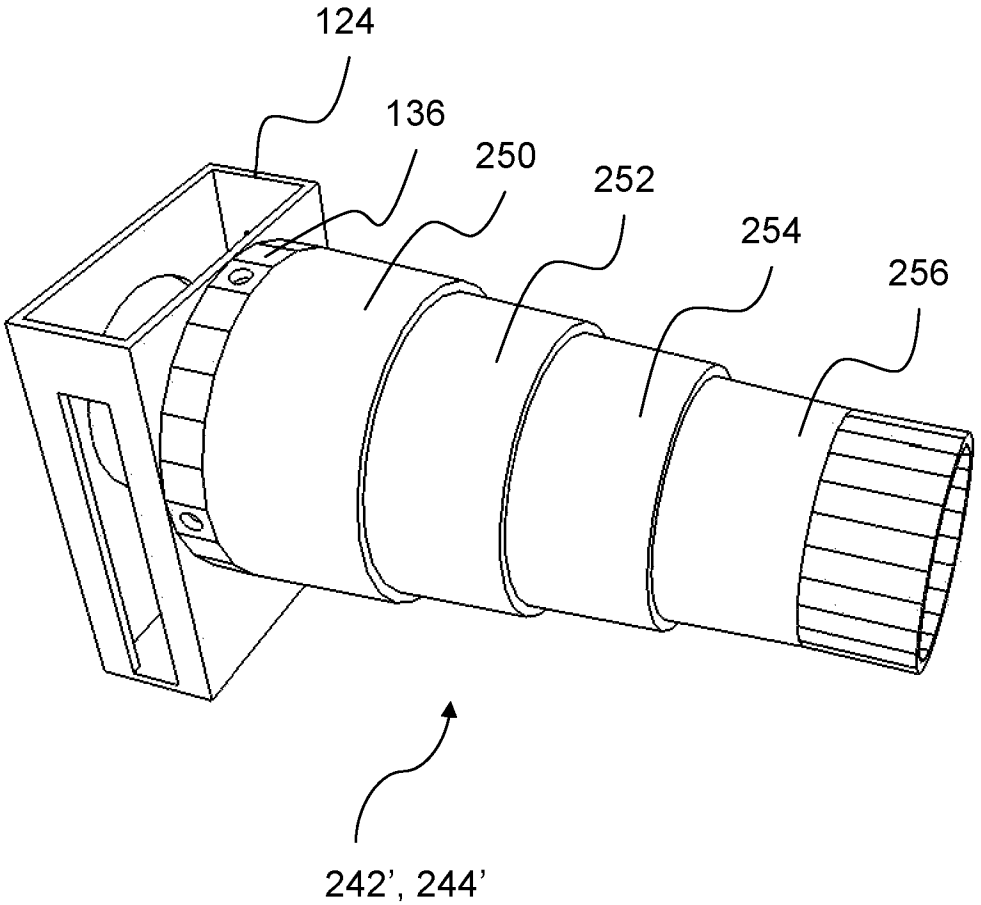
FIGS. 19-20 show a support structure of the second embodiment of the lighting sleeve device of the present invention that has a collapsible funnel-shaped portion.
Figure 20:
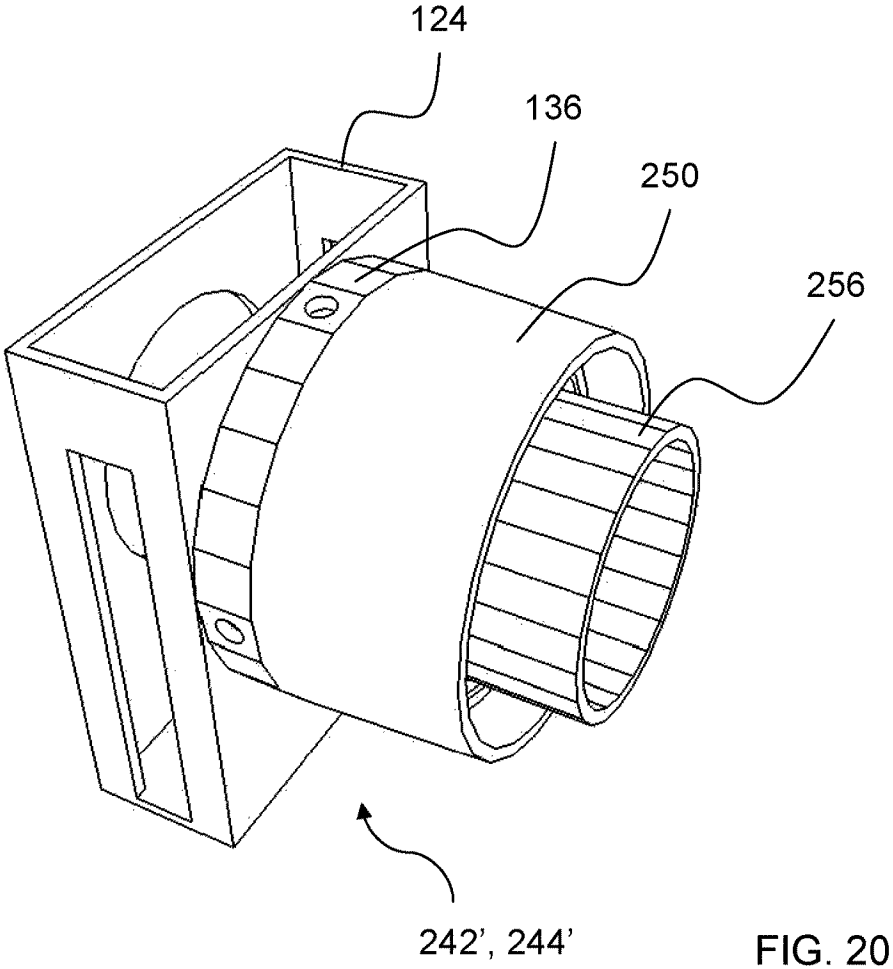
Figure 21:
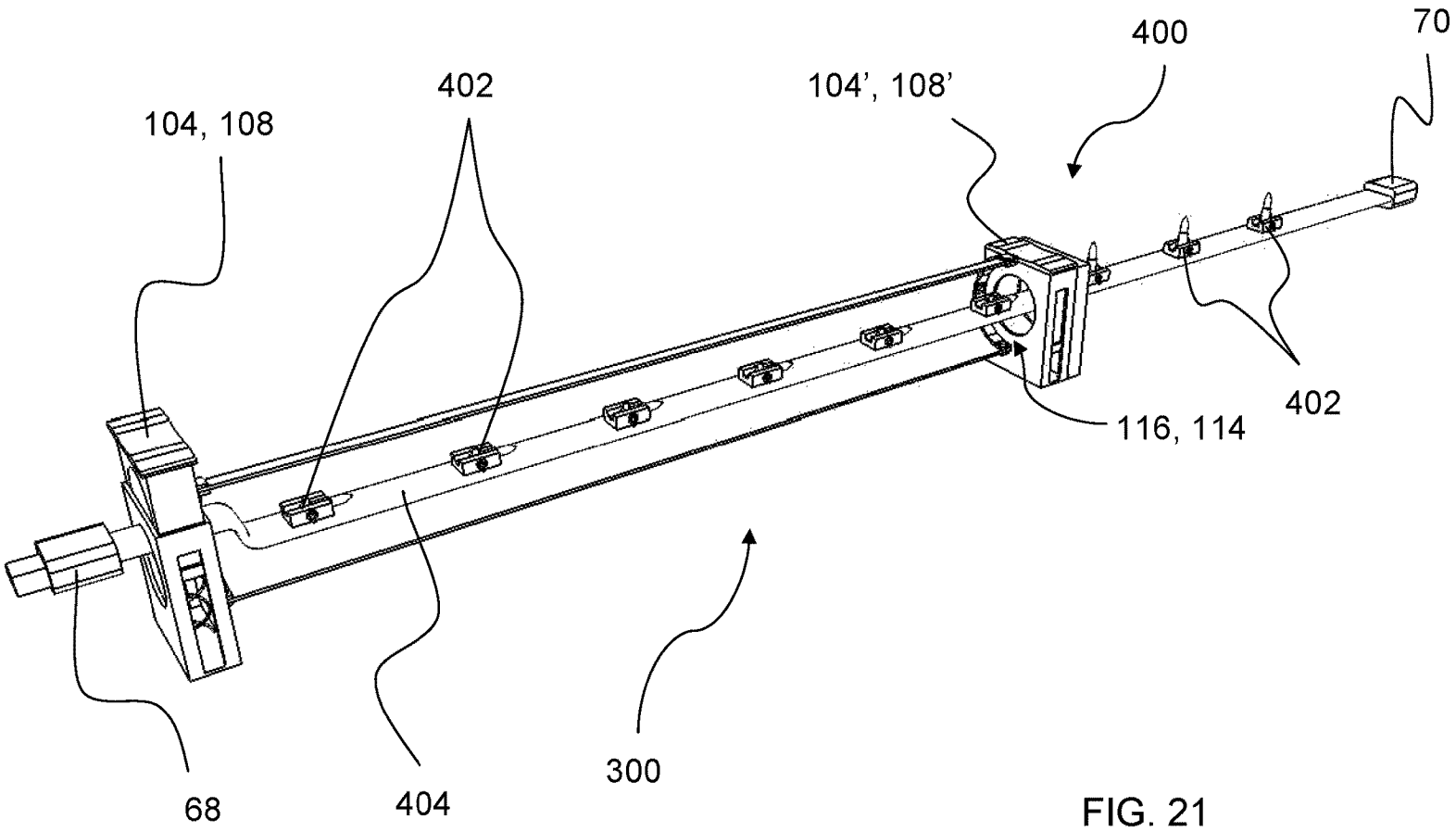
FIGS. 21-25 show a third embodiment of the lighting sleeve device of the present invention for use with a lighting string of the present invention that has retractable lights.
Figure 22:
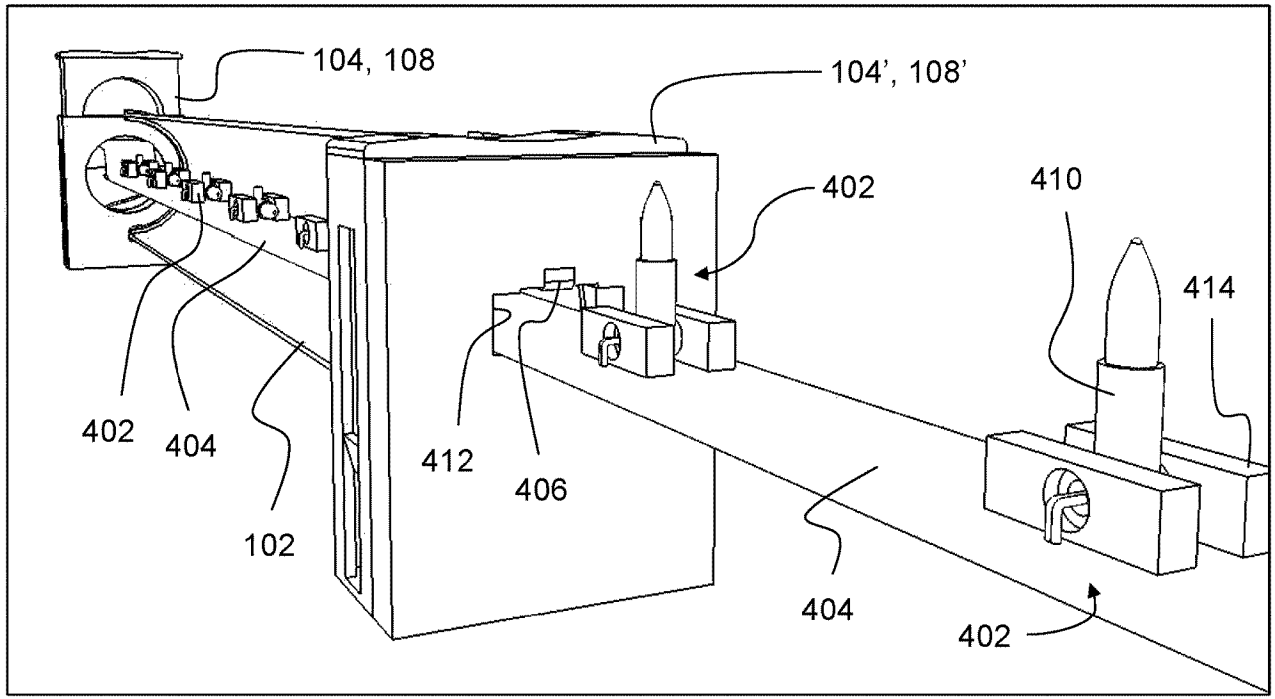
Figure 24:
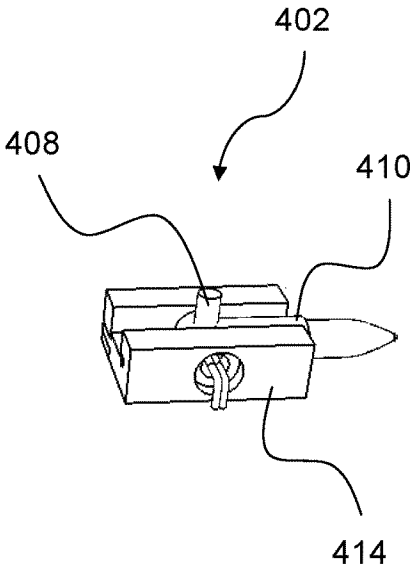
Figure 23:
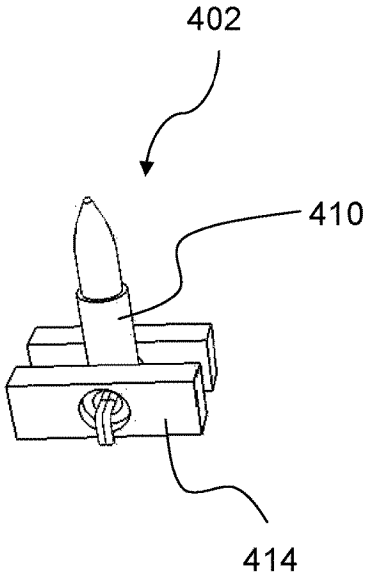
Figure 25:
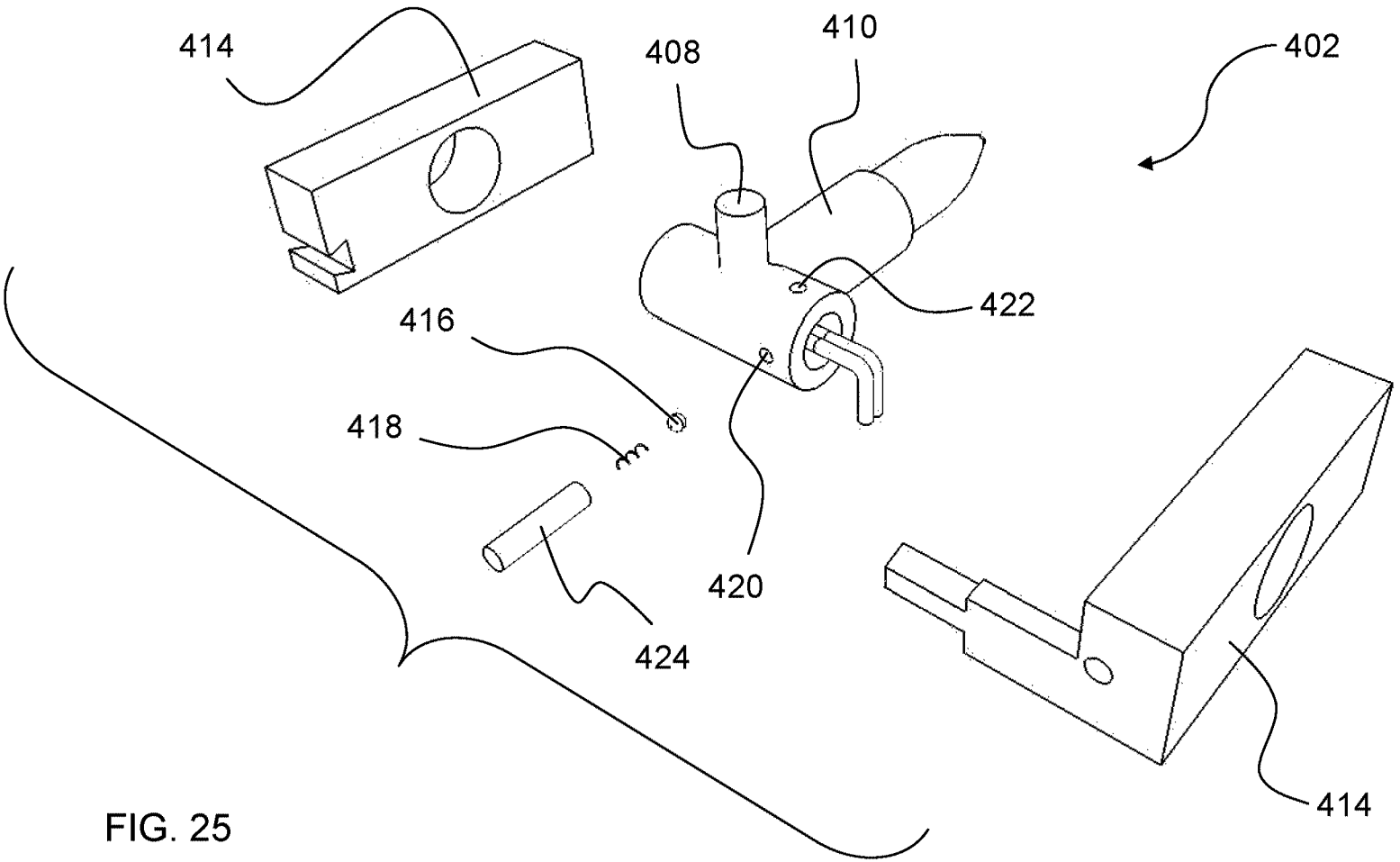

Each of the funnel-shaped portion 242' of the first support structure and the funnel-shaped portion 244' of the second support structure may be segmented with each having a plurality of segments 250, 252, 254, and 256 that are arranged in telescoping fashion such that each of the funnel-shaped portion of the first support structure and the funnel-shaped portion of the second support structure is collapsible and can be placed in a collapsed configuration and an extended configuration. Each of the funnel-shaped portion 242 of the first support structure and the funnel-shaped portion 244 of the second support structure can thus be more compact in the collapsed configuration so as to minimize interference with functioning of the sleeve 102. An example of a collapsible or telescoping funnel-shaped portion of the first and second support structures is shown in the extended and collapsed states or configurations in FIGS. 19 and 20, respectively.

Referring to FIGS. 21-25, a third embodiment 300 of the lighting sleeve device of the present invention can be seen. The device 300 is similar in many respects to the lighting sleeve devices 100 and 200. In the interest of brevity, only the differences between the lighting sleeve devices 300 and the embodiments 100 and 200 are discussed in detail.

The lighting sleeve device 300 is adapted for use with a lighting string 400 of the present invention that is provided with retractable lights 402. The lighting string 400 includes a plurality of lights 402 and a wiring assembly 404. The wiring assembly connects the plurality of lights 402 to a source of energy for powering the emission of light from the plurality of lights using the male or female connectors 68 and 70, respectively. The wiring assembly 404 has a length and the plurality of lights 402 are distributed along the length of the wiring assembly 404. Each of the plurality of lights 402 is retractable and moves between a retracted position and a deployed position. The operation of the clamps 104' and 108' is identical to the operation of the clamps 104 and 108; therefore, they will not be discussed in detail.

At least one of the first clamp 104' and the second clamp 108' supports a camming surface 406 in proximity to a corresponding access opening 114 or 116 of the sleeve 102. Each of the plurality of lights 402 has a cam follower 408 that engages the camming surface 406 as each of the lights 402 is withdrawn from, i.e. pulled out of, the sleeve 102 such that each of the lights 402 is moved from its retracted position to its deployed position as each of the lights 402 is pulled out of the sleeve. When the clamp 104, 108 is moved relative to the lights 402 so as to place each light 402 in the interior of the sleeve 102, the movement of the light 402 is reversed. This time, the camming surface 406 acts on the light socket 410 and moves each of the lights 402 from its deployed position to its retracted position as each of the lights 402 relatively moves to enter the interior of the sleeve 102.

In the illustrated embodiment, the camming surface 406 is semi-circular in cross section and is provided in a lighting string guideway 412 that is fixed to the corresponding clamp 104' or 108'. The guideway 412 is configured and sized to ensure that the camming surface 406 will come into contact with cam follower 408 and the light socket 410 as required. The light socket 410 is pivotally supported by a base 414 that is fixedly attached to the wiring assembly 404. The cam follower 408 and the light socket 410 are fixed together and rotate as a unit. The cam follower 408 extends radially from the same pivot axis as the light socket 410 at a 90 degree angle relative to the longitudinal axis of the light socket 410. As the light 402 is pulled out of the sleeve 102, the camming surface 406 engages the cam follower 408 and causes the light socket 410 to pivot 90 degrees to the deployed position. As the light 402 relatively moves to enter the interior of the sleeve 102, the camming surface 406 engages the light socket 410 and causes the light socket 410 to pivot 90 degrees to the retracted position. A detent including a ball 416 and spring 418 acts on depressions 420 and 422 to hold the light 402 in the retracted and deployed positions, respectively. The spring 418 urges the ball 416 into engagement with the depressions 420 and 422, when either of the depressions is in registry with the ball. A plug 424 keeps the spring 418 confined behind the ball 416.

It should be understood that the present invention is not limited to the specific embodiments described above, but includes any and all variations or modifications within the spirit and scope of the present invention as defined in the appended claims.

The invention claimed is:

1. A device for holding a lighting string, the lighting string comprising a plurality of lights and a wiring assembly for connecting the plurality of lights to a source of energy for powering the emission of light from the plurality of lights, the wiring assembly having a length and the plurality of lights being distributed along the length of the wiring assembly, the device comprising:

a sleeve having a first end, a second end, a length, an inner space, a first access opening at said first end, and a second access opening at said second end;

a first clamp for holding a portion of the wiring assembly of the lighting string;

a first support structure for supporting said first clamp in proximity to said first access opening, said first clamp being connected to and supported by said first support structure in proximity to said first access opening, said first support structure being attached to said sleeve in proximity to said first access opening;

a second clamp for holding a portion of the wiring assembly of the lighting string; and a second support structure for supporting said second clamp in proximity to said second access opening, said second clamp being connected to and supported by said second support structure in proximity to said second access opening, said second support structure being attached to said sleeve in proximity to said second access opening, wherein said sleeve is capable of receiving the plurality of lights and a portion of the wiring assembly supporting the plurality of lights in the inner space of the sleeve, wherein the first clamp clamps a first clamped portion of the wiring assembly, wherein the second clamp clamps a second clamped portion of the wiring assembly, and wherein the portion of the wiring assembly supporting the plurality of lights is intermediate the first clamped portion of the wiring assembly and the second clamped portion of the wiring assembly to thereby secure the plurality of lights and the portion of the wiring assembly supporting the plurality of lights in the inner space of the sleeve;

wherein said sleeve is flexible and said lights can operate while inside the sleeve, wherein said sleeve acts as a diffuser allowing light from said plurality of lights to shine or pass through said sleeve such that the lights can be used for decorative purposes while inside said sleeve, and wherein said first clamp and said second clamp are spring loaded and each has at least one respective spring such that they each exert a clamping force on said wiring assembly when each is engaged to said wiring assembly and that said clamping force is provided by said at least one respective spring for each of said first clamp and said second clamp.

2. The device of claim 1, wherein said sleeve has perforations that allow light from said plurality of lights to shine or pass through said sleeve.

3. A device for holding a lighting string, the lighting string comprising a plurality of lights and a wiring assembly for connecting the plurality of lights to a source of energy for powering the emission of light from the plurality of lights, the wiring assembly having a length and the plurality of lights being distributed along the length of the wiring assembly, the device comprising:

a sleeve having a first end, a second end, a length, an inner space, a first access opening at said first end, and a second access opening at said second end;

a first clamp for holding a portion of the wiring assembly of the lighting string;

a first support structure for supporting said first clamp in proximity to said first access opening, said first clamp being connected to and supported by said first support structure in proximity to said first access opening, said first support structure being attached to said sleeve in proximity to said first access opening;

a second clamp for holding a portion of the wiring assembly of the lighting string; and a second support structure for supporting said second clamp in proximity to said second access opening, said second clamp being connected to and supported by said second support structure in proximity to said second access opening, said second support structure being attached to said sleeve in proximity to said second access opening, wherein said sleeve is capable of receiving the plurality of lights and a portion of the wiring assembly supporting the plurality of lights in the inner space of the sleeve, wherein the first clamp clamps a first clamped portion of the wiring assembly, wherein the second clamp clamps a second clamped portion of the wiring assembly, and wherein the portion of the wiring assembly supporting the plurality of lights is intermediate the first clamped portion of the wiring assembly and the second clamped portion of the wiring assembly to thereby secure the plurality of lights and the portion of the wiring assembly supporting the plurality of lights in the inner space of the sleeve;

wherein said first clamp and said second clamp are spring loaded and each has at least one respective spring such that they each exert a clamping force on said wiring assembly when each is engaged to said wiring assembly and that said clamping force is provided by said at least one respective spring for each of said first clamp and said second clamp.

4. A device for holding a lighting string, the lighting string comprising a plurality of lights and a wiring assembly for connecting the plurality of lights to a source of energy for powering the emission of light from the plurality of lights, the wiring assembly having a length and the plurality of lights being distributed along the length of the wiring assembly, the device comprising:

a sleeve having a first end, a second end, a length, an inner space, a first access opening at said first end, and a second access opening at said second end;

a first clamp for holding a portion of the wiring assembly of the lighting string;

a first support structure for supporting said first clamp in proximity to said first access opening, said first clamp being connected to and supported by said first support structure in proximity to said first access opening, said first support structure being attached to said sleeve in proximity to said first access opening;

a second clamp for holding a portion of the wiring assembly of the lighting string; and a second support structure for supporting said second clamp in proximity to said second access opening, said second clamp being connected to and supported by said second support structure in proximity to said second access opening, said second support structure being attached to said sleeve in proximity to said second access opening, wherein said sleeve is capable of receiving the plurality of lights and a portion of the wiring assembly supporting the plurality of lights in the inner space of the sleeve, wherein the first clamp clamps a first clamped portion of the wiring assembly, wherein the second clamp clamps a second clamped portion of the wiring assembly, and wherein the portion of the wiring assembly supporting the plurality of lights is intermediate the first clamped portion of the wiring assembly and the second clamped portion of the wiring assembly to thereby secure the plurality of lights and the portion of the wiring assembly supporting the plurality of lights in the inner space of the sleeve;

the device further comprising a lighting string comprising:

a plurality of lights; and a wiring assembly for connecting the plurality of lights to a source of energy for powering the emission of light from the plurality of lights, the wiring assembly having a length and the plurality of lights being distributed along the length of the wiring assembly, wherein each of said plurality of lights is retractable and moves between a retracted position and a deployed position wherein at least one of said first clamp and said second clamp supports a camming surface in proximity to a corresponding access opening of said sleeve and each of said plurality of lights has a cam follower that engages said camming surface as each of said lights is withdrawn from said sleeve such that each of said lights is moved from its retracted position to its deployed position as each of said lights is pulled out of said sleeve.

5. A device for holding a lighting string, the lighting string comprising a plurality of lights and a wiring assembly for connecting the plurality of lights to a source of energy for powering the emission of light from the plurality of lights, the wiring assembly having a length and the plurality of lights being distributed along the length of the wiring assembly, the device comprising:

a sleeve having a first end, a second end, a length, an inner space, a first access opening at said first end, and a second access opening at said second end;

a first clamp for holding a portion of the wiring assembly of the lighting string;

a first support structure for supporting said first clamp in proximity to said first access opening, said first clamp being connected to and supported by said first support structure in proximity to said first access opening, said first support structure being attached to said sleeve in proximity to said first access opening;

a second clamp for holding a portion of the wiring assembly of the lighting string; and a second support structure for supporting said second clamp in proximity to said second access opening, said second clamp being connected to and supported by said second support structure in proximity to said second access opening, said second support structure being attached to said sleeve in proximity to said second access opening, wherein said sleeve is capable of receiving the plurality of lights and a portion of the wiring assembly supporting the plurality of lights in the inner space of the sleeve, wherein the first clamp clamps a first clamped portion of the wiring assembly, wherein the second clamp clamps a second clamped portion of the wiring assembly, and wherein the portion of the wiring assembly supporting the plurality of lights is intermediate the first clamped portion of the wiring assembly and the second clamped portion of the wiring assembly to thereby secure the plurality of lights and the portion of the wiring assembly supporting the plurality of lights in the inner space of the sleeve;

wherein each of said first support structure and said second support structure comprises a funnel shaped portion to ease the insertion of the lighting string into said sleeve.

6. The device of claim 5, wherein each of said funnel shaped portion of said first support structure and said funnel shaped portion of said second support structure has an inner end and wherein said inner end of said funnel shaped portion of said first support structure and said inner end of said funnel shaped portion of said second support structure are engageable to each other to ease passage of one end of the lighting string completely through the entire sleeve.

7. The device of claim 5, wherein each of said funnel shaped portion of said first support structure and said funnel shaped portion of said second support structure is segmented with each having a plurality of segments that are arranged in telescoping fashion such that each of said funnel shaped portion of said first support structure and said funnel shaped portion of said second support structure is collapsible and can be placed in a collapsed configuration and an extended configuration, and wherein each of said funnel shaped portion of said first support structure and said funnel shaped portion of said second support structure is more compact in said collapsed configuration so as to minimize interference with functioning of said sleeve.

* * * * *